US008887940B2

(12) United States Patent
Kiceniuk, Jr. et al.

(10) Patent No.: US 8,887,940 B2
(45) Date of Patent: Nov. 18, 2014

(54) PORTABLE PAINT AND TOOL CONTAINER

(75) Inventors: Taras Kiceniuk, Jr., Santa Paula, CA (US); John Denton Lockwood, Ventura, CA (US)

(73) Assignee: Taras Kiceniuk, Jr., Santa Paula, CA (US)

( * ) Notice: Subject to any disclaimer, the term of this patent is extended or adjusted under 35 U.S.C. 154(b) by 572 days.

(21) Appl. No.: 13/135,382

(22) Filed: Jun. 30, 2011

(65) Prior Publication Data

US 2012/0037634 A1 Feb. 16, 2012

Related U.S. Application Data

(60) Provisional application No. 61/401,612, filed on Aug. 16, 2010.

(51) Int. Cl.

| | |
|---|---|
| ***B65D 25/14*** | (2006.01) |
| ***B44D 3/14*** | (2006.01) |
| ***B44D 3/12*** | (2006.01) |
| *B05C 17/02* | (2006.01) |
| *A45F 3/14* | (2006.01) |

(52) U.S. Cl.

CPC *B44D 3/126* (2013.01); *B44D 3/14* (2013.01); *B44D 3/121* (2013.01); *B05C 17/0245* (2013.01); *A45F 2200/0575* (2013.01); *B44D 3/127* (2013.01); *A45F 2003/148* (2013.01)

USPC ..... 220/495.02; 220/697; 220/735; 220/482; 206/361; 248/610; 248/322; 248/339

(58) Field of Classification Search

CPC ..... B44D 3/14; B44D 3/121; B05C 17/0245

USPC ..... 220/657, 697, 735, 694, 476, 480, 482; 206/216, 349, 361; 248/690, 322, 339

See application file for complete search history.

(56) References Cited

U.S. PATENT DOCUMENTS

| | | | |
|---|---|---|---|
| 2,659,917 | A | 11/1953 | Drum |
| 2,988,767 | A | 6/1961 | Tretwold |
| 3,283,971 | A | 11/1966 | Jones |
| 3,351,970 | A | 11/1967 | Engh |
| 3,425,012 | A | 1/1969 | Gottinger |
| 3,536,285 | A | 10/1970 | Vaughn |
| 3,997,092 | A | 12/1976 | Pogwizd |
| 4,101,046 | A | 7/1978 | Puntillo |
| 4,122,973 | A | 10/1978 | Ahern |
| 4,205,411 | A | 6/1980 | Cupp |
| 4,297,762 | A | 11/1981 | Crysdale |
| 4,363,433 | A | 12/1982 | Jaques |
| 4,746,042 | A | 5/1988 | King |
| 4,860,891 | A | 8/1989 | Biggio |
| 4,928,843 | A | 5/1990 | Gunderson |
| 4,964,601 | A | 10/1990 | Dishman |
| 5,007,553 | A | 4/1991 | Curtis |
| 5,033,704 | A | 7/1991 | Kerr |
| 5,046,749 | A | 9/1991 | Owens |
| D321,070 | S | 10/1991 | Lewicki |

(Continued)

*Primary Examiner* — Robert J Hicks
*Assistant Examiner* — Kareen Rush

(57) ABSTRACT

A container is provided for carrying a quantity of paint and a plurality of tools; a flange element is comprised having a variety of holes, recesses and magnets to receive tools and supplies; the container optionally comprising a bail type handle, sealing lid and carrying strap.

35 Claims, 21 Drawing Sheets

(56) References Cited

U.S. PATENT DOCUMENTS

| | | | | |
|---|---|---|---|---|
| 5,083,733 | A | 1/1992 | Marino | |
| 5,156,411 | A | 10/1992 | Owens | |
| 5,201,439 | A | 4/1993 | Davies | |
| 5,207,348 | A | 5/1993 | Fischer | |
| 5,276,943 | A | 1/1994 | Ludy | |
| 5,283,928 | A | 2/1994 | Linn | |
| 5,303,500 | A * | 4/1994 | Luukonen | 43/54.1 |
| D353,241 | S | 12/1994 | Breen | |
| D355,287 | S | 2/1995 | Camp, Jr. | |
| 5,400,916 | A | 3/1995 | Weber | |
| 5,402,910 | A | 4/1995 | Pilney | |
| D361,183 | S | 8/1995 | Pilney | |
| 5,493,751 | A | 2/1996 | Misiukowiec | |
| 5,511,279 | A | 4/1996 | Ippolito | |
| 5,549,216 | A | 8/1996 | Scholl | |
| 5,641,087 | A | 6/1997 | Moffitt | |
| 5,695,098 | A | 12/1997 | King | |
| 5,746,346 | A | 5/1998 | Crilly | |
| 5,791,608 | A | 8/1998 | Nielsen | |
| 5,799,819 | A | 9/1998 | Nimer | |
| 5,810,196 | A | 9/1998 | Lundy | |
| 5,836,043 | A | 11/1998 | Rovas | |
| 5,842,253 | A | 12/1998 | Ahl | |
| D415,864 | S | 10/1999 | Axhamre | |
| 6,138,963 | A | 10/2000 | Malvasio | |
| D438,680 | S | 3/2001 | Cogdill | |
| 6,260,730 | B1 | 7/2001 | Fellman | |
| 6,283,345 | B1 | 9/2001 | Butschat | |
| 6,431,392 | B1 | 8/2002 | Eisenbeisz | |
| D477,702 | S | 7/2003 | Kohn | |
| 6,769,136 | B1 | 8/2004 | Martelly | |
| 6,783,021 | B2 * | 8/2004 | Kaura | 220/482 |
| 6,907,640 | B2 * | 6/2005 | Rougeau | 15/257.06 |
| 6,929,225 | B1 | 8/2005 | Kent | |
| 6,945,440 | B1 | 9/2005 | Ford | |
| 6,991,829 | B2 | 1/2006 | Bergman | |
| 7,137,168 | B2 | 11/2006 | Mann | |
| D546,514 | S | 7/2007 | Byrne | |
| 7,913,446 | B1 * | 3/2011 | Aldridge, III | 43/57.1 |
| 8,505,728 | B2 * | 8/2013 | Su | 206/499 |
| 2002/0117592 | A1 | 8/2002 | Traylor | |
| 2003/0233719 | A1 | 12/2003 | Wolfinger | |
| 2005/0156085 | A1 | 7/2005 | Radovan | |
| 2007/0285824 | A1 | 12/2007 | Cornelissen | |

* cited by examiner

Section B-B

PORTABLE PAINT AND TOOL CONTAINER

RELATED PRIOR APPLICATIONS

U.S. Provisional patent ID No. 61/401,612 filed on date Aug. 16, 2010 is referenced for a priority date.

U.S. Design patent application No. 29/385,604 EFSID 9462510 filed on date Feb. 16, 2011 is a related design patent to the present invention.

FIELD OF INVENTION

The present invention relates to the field of buckets, paint trays and other hand-carried containers for liquids and tools, particularly for the carrying and applying of paint.

BACKGROUND OF INVENTION

The standard horizontal paint roller tray has remained in wide use despite many inventions directed at improving the worker's access to paint and at providing a roller paint distributing or spreading surface in convenient proximity to a stable paint-holding reservoir.

Some of the impetus for the present invention comes from the various shortcomings of the standard horizontal roller pan.

The problems with the standard pan include: lack of stability when used on a ladder; small paint capacity; and lack of portability. The instability experienced while a horizontal roller tray is carried has been demonstrated over the years and is known to all those skilled in the art of roller painting. A significant need exists for a more ergonomic alternative to the prevalent prior art.

From the year 1953, U.S. Pat. No. 2,659,917 by Drum teaches an improved surface for distributing paint on a roller for a horizontal paint tray. Drum provides a textured drainable surface where excess paint can be removed from the roller.

Currently it is common practice for people who paint with a roller to use a porous paint screen in a bucket, or to use a standard roller tray. Various specialty buckets are available which offer substantially vertical roller paint distributing elements. Several patents for such devises are listed below as well as other relevant prior art.

From 1961, U.S. Pat. No. 2,988,767, A. Tretwald, et al. teach a bucket with a flat vertical section on the inside to distribute paint on a paint roller.

From 1967, U.S. Pat. No. 3,351,970 by Engh, teaches a paint container with a substantially vertical paint distributing surface. Engh teaches the use of a shoulder strap, a bail handle and a means of attaching the container to the front of a ladder. The Engh tray may be used in a horizontal or vertical position.

From 1969, U.S. Pat. No. 3,425,012, Gottinger teaches the use of a magnet for securing a paint brush to the side of a metal paint can.

From 1970, U.S. Pat. No. 3,536,285, Vaughn uses magnetic means for holding a paint brush.

In U.S. Pat. No. 3,997,092 (1976), Pogwizd shows a harness and provisions for holding a brush and a paint scraper. Pogwizd also teaches the use of a pivoting lid.

In U.S. Pat. No. 4,101,046 (1978), Puntillo uses a magnet to suspend a paint brush over a paint can.

From 1990, U.S. Pat. No. 4,964,601, Dishman discloses the use of elastic bands to attach a paint container to the side of a ladder.

From 1989, U.S. Pat. No. 4,860,891, Viggio discloses a paint and brush holder that incorporates a rear handle and, in front, a horizontal brush-grooming ledge.

In U.S. Pat. No. 5,046,749 (1991), Owens describes a paint-holding container where two of the vertical sides provide means of distributing paint on a paint roller.

In U.S. Pat. No. 5,928,843, Gunderson describes an invention which uses the lid of a paint container in a relocated vertical position to distribute paint on a roller.

In U.S. Pat. DES.321,070, Lewicki shows the ornamental design for a paint tray holder with paint roller support.

In U.S. Pat. No. 5,156,411, Owens teaches the use of a vertical roller surface in conjunction with a paint splatter shield.

In Fischer, et al, U.S. Pat. No. 5,207,348, the inventors describe an insert for a five-gallon bucket which includes a textured paint roller surface.

In U.S. Pat. No. 4,746,042, King provides a holder for a wet paint brush that is worn on the user's belt.

From 1992, in U.S. Pat. No. 5,083,733 Marino, et al describe a brush holder incorporating a plurality of magnets.

In the 1990s a vertical roller paint tray with a rear-sided outward then downward protruding flange was sold in the country of Argentina, this container also incorporated a slanted open top, tallest in back, and a flexible cord handle, as well as horizontal striations in the rear wall; This container had rectangular plan-form shape, most narrow front to back with square corners; it was proportioned to work with a standard full-size paint roller.

In U.S. Pat. No. 5,033,704, Kerr teaches a magnetic brush holder incorporating a horizontal shelf.

In U.S. Pat. No. 5,276,943, Ludy discloses a handle for a paint can that facilitates suspending the can from a ladder.

In U.S. Pat. No. 5,201,439, Davies discloses a paint tray that can function with the roller paint-distributing surface oriented either horizontally or vertically. Davies also teaches the use of a roller holding clip or notch.

In U.S. Pat. No. 5,402,910 Pilney discloses a paint container which can hang from the rungs of a ladder. His invention incorporates vertical roller paint-spreading surfaces, and a sealing lid is provided.

Ippolito, in U.S. Pat. No. 5,511,279, describes a stackable paint roller pan that has an enlarged one-quart capacity and an adjustable one-hand carrying handle.

Weber, in U.S. Pat. No. 5,400,916, describes a paint roller bucket which includes a steeply inclined roller paint distributing surface as well as a pivoting bail handle and a pour spout.

In U.S. Pat. No. 5,493,751, Misiukowiec et al describe a paint pan which can hang on the rung of a ladder and has a vertical roller paint distributing surface. The invention provides a lid, and is designed to function also in a substantially horizontal position.

King, U.S. Pat. No. 5,695,098, discloses a belt- or strap-supported holder for a wet paint brush or roller.

Moffitt, U.S. Pat. No. 5,641,087, presents a paint bucket for a mini-roller which includes a central wedge-like structure comprising two nearly vertical roller paint distributing surfaces.

Scholl, U.S. Pat. No. 5,549,261, describes a paint holder and delivery device which includes a removable, but non-disposable, liner.

From 1998, U.S. Pat. No. 5,746,346, Crilly describes a paint carrier which incorporates a non-magnetic brush holder on the inside of the paint-holding container.

Lundy, U.S. Pat. No. 5,810,196, describes a paint bucket which incorporates a brush-holding recess and a porous, inclined roller paint-distributing grid.

Ahl, et al, in U.S. Pat. No. 5,842,253, describe a ladder-supported paint holding tray with notches for supporting a paint roller.

Rovas, in U.S. Pat. No. 5,836,043, teaches a paint tray with a specialized bail handle that enables the container to hang from the rungs of a ladder and also be used flat on a horizontal surface.

Kohns, U.S. Pat. D 477,702 S, discloses the ornamental design for a paint bucket with a bail handle and a substantially vertical roller paint distributing textured surface.

Malvasio, U.S. Pat. No. 6,138,963, describes a paint cup and brush holder incorporating a handle and pour spout. It is molded to provide for relatively compact stackability.

Butschat, U.S. Pat. No. 6,283,345 B1, describes a paint container system which can be worn on the user's belt and includes a means of holding a wet brush within the container.

Eisenbelsz, U.S. Pat. No. 6,431,392 B1, describes a detachable handle mechanism for carrying a conventional paint roller tray pan.

Fellman, U.S. Pat. No. 6,260,730 B1, describes an insert for a standard paint bucket, which provides a substantially vertical roller paint distributing surface.

Byrne, U.S. Pat. D546,514 S, describes the ornamental design for a paint bucket that includes a substantially vertical roller paint distributing surface.

Bergman, U.S. Pat. No. 6,991,829 B2, describes a hand-held vessel for holding paint which incorporates an adjustable handle as well as a brush-holding magnet.

Martelly, U.S. Pat. No. 6,769,136 B1, teaches the use of an apron and a paint container in combination.

Kent, U.S. Pat. No. 6,929,225 B1, describes a clip with a brush-holding magnet for use on the side of a paint container.

Ford, U.S. Pat. No. 6,945,440 B1, describes a paint bucket which has a hinging lid and a flexible strap.

OBJECTS OF THE PRESENT INVENTION

A primary object of the present invention is to provide painters with convenient and ergonomic means of transporting and applying paint; a further object is providing specific means for carrying a plurality of paint-spreading, repair and clean-up tools. The present invention is intended to facilitate effective dispensing and applying of paint.

An object of the invention is to provide an outward- then downward-turning flange that encircles the top opening of the container; the flange with its holes and lobes can receive, store and transport a plurality of tools and some supplies.

An object of the invention is to provide specialized holes and magnetized receptacles for receiving tools and supplies. The tools for which receptacles are provided can include, but are not limited to: paint roller, paint brush, paint scraper, cleaning cloth, putty knife, screwdriver, standard pencil, carpenter's pencil and tape measure.

An object of the invention is to provide a cloth-holding receptacle, or a plurality thereof, that can be comprised in the tool-holding flange, thereby providing convenient means of storing a cloth for clean-up purposes.

An additional object of the invention is to provide means of supporting a paintbrush within the container, such that it is above the level of the liquid paint. It may be desirable to store a brush inside while the sealing lid is closed in place.

A further object of the present invention is to provide magnetic means of holding a paint brush or multiple brushes in a secure position that enables them to drain excess paint back into the container.

An additional object of the invention is to provide a bi-functional means of simultaneously securing tools on either side of a magnet.

Another object of the invention is to provide a novel easily-detachable shoulder strap which stays in place on the operator with or without a container attached.

Such a strap enables the operator to have hands free while using the invention to carry supplies and tools. This feature is found be helpful when working with a ladder.

An additional object of the invention is to provide a secure sealing lid, which is equipped with a notch which allows the handle of a paint roller tool to protrude from the container while the paint-wet portion of the roller tool is protected from drying out within the container.

A further object of the invention is to provide a moveable flap, which can be used to seal the notch hole in the lid when no paint roller tool handle is in place.

Another objective is to create an invention which is inexpensive to manufacture by being molded from plastic.

A further object of the invention is to provide for compact, jam-proof stackability, for storage and transportation.

An object of the invention is to provide a container and tool holder which may be enclosed or stored entirely within a closed standard five-gallon paint bucket.

An object of the invention is to provide an outward- and downward-turning flange around the top of the container, said flange being suitable for holding a plurality of tools.

Another object of the invention is to provide an angle on the open top of the container to allow easier access to its contents.

An additional object of the invention is to provide a replaceable liner for the container, where the liner can extend over and around the top sealing lip of the container, enabling the sealing lid to function approximately normally both with or without a liner in place.

An additional object is to provide a means of holding a porous paint spreader screen within the container, to provide a stable means to effectively distribute paint/coatings on a roller, where said screen will not interfere with application of a sealing lid.

An object of the invention is to provide multiple means of supporting the invention while in use, comprising means of resting on horizontal surfaces and hanging from ladders, knobs, shelves, ledges, cabinet doors, chair backs, etc.

An additional object of the invention is to provide retractable legs that provide additional stability for the invention when it is resting on a horizontal surface, but which can be folded away when the container is suspended from a ladder, carried, or the like.

An additional object of the invention is to provide a multi-position bail handle which engages a stop and produces an ergonomic two-element handhold in conjunction with the invention's back flange.

An additional object of the invention is to provide a tool-holding slot in proximity to a magnet which can securely hold a paint-scraping tool or putty knife.

An additional object of the invention is to provide means of holding painter's putty or the like.

An additional object of the invention is to provide means of holding a clip-on tool such as a tape measure, or a clip-on tool pouch capable of holding additional tools or accessories.

SUMMARY OF THE INVENTION

The present invention of a Portable Paint and Tool Container provides convenient and ergonomic means of carrying and using a liquid such as paint and/or a plurality of tools within a work or hobby environment. An embodiment is disclosed that can hold a quantity of paint as well as a variety of tools, which may be used in conjunction with the paint. A versatile handle can be provided, enabling the container to be comfortably carried and used with various different hand positions. An optional detachable shoulder strap is disclosed, which allows the user to transport the container and yet have both hands free for other needs. The container can be configured to hang securely on the side of a ladder as well as rest stably on a horizontal surface. A special rear flange can provide means of supporting the container on a cupboard door, chair, drawer, or doorknob. The invention has proven itself to be useful in various activities that require a small collection of tools and materials, as well as in the primary tasks of painting and paint preparation.

DETAILED DESCRIPTION OF PREFERRED EMBODIMENTS

Exemplary preferred embodiments of the present invention are disclosed herein with reference to the several drawing figures. It will be understood by one skilled in the art that the various features and elements disclosed herein may be assembled in a multitude of alternative combinations and still fall within the scope of the present invention.

This description of exemplary preferred embodiments is provided as specific examples of embodiments within a group of variations, and it will be understood that this description and disclosure is not intended to limit the scope of the invention except as specifically announced in the claims.

Figure 1:
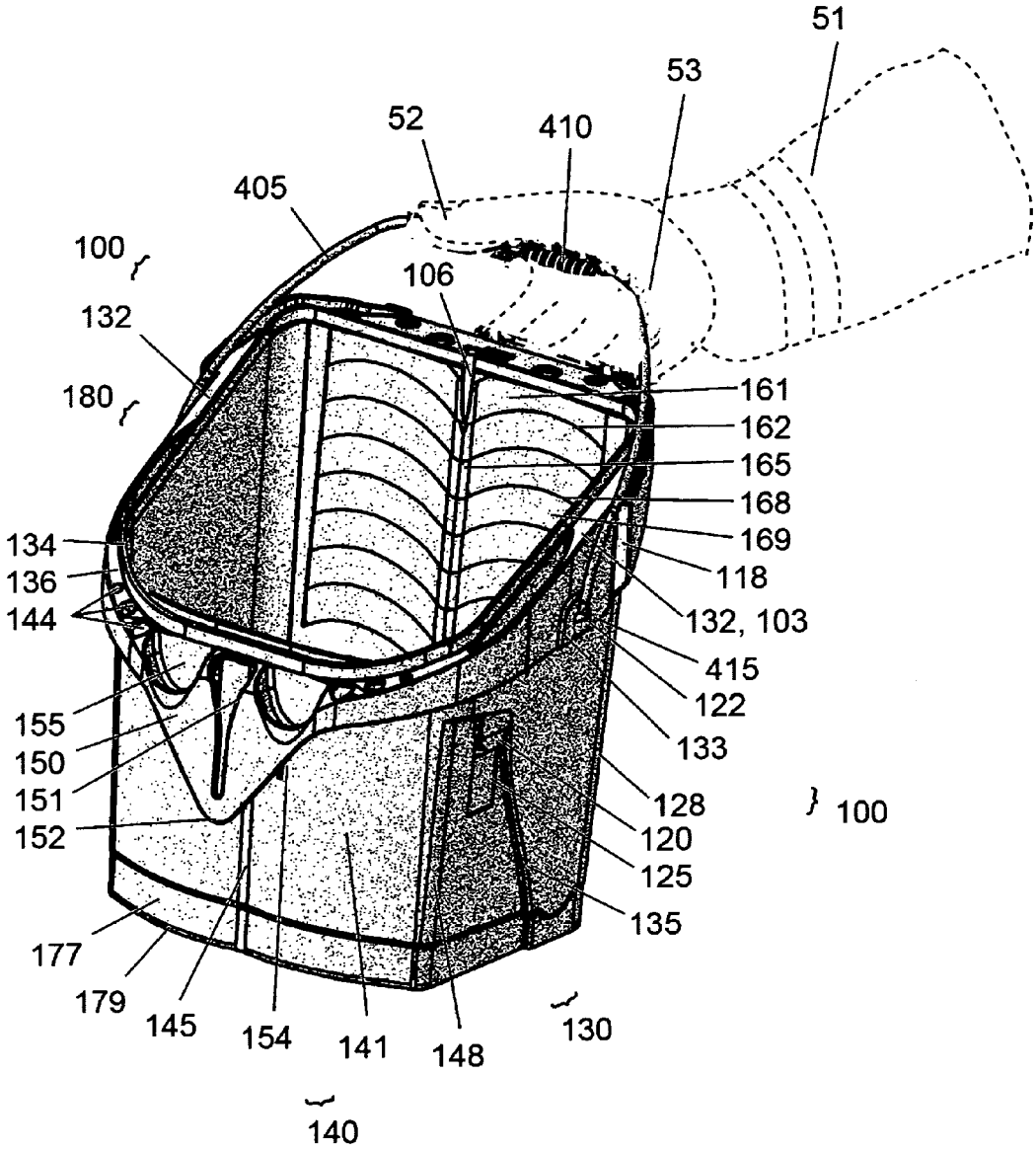
FIG. 1. Front prospective view of an operator's hand holding the present invention.
Figure 2:
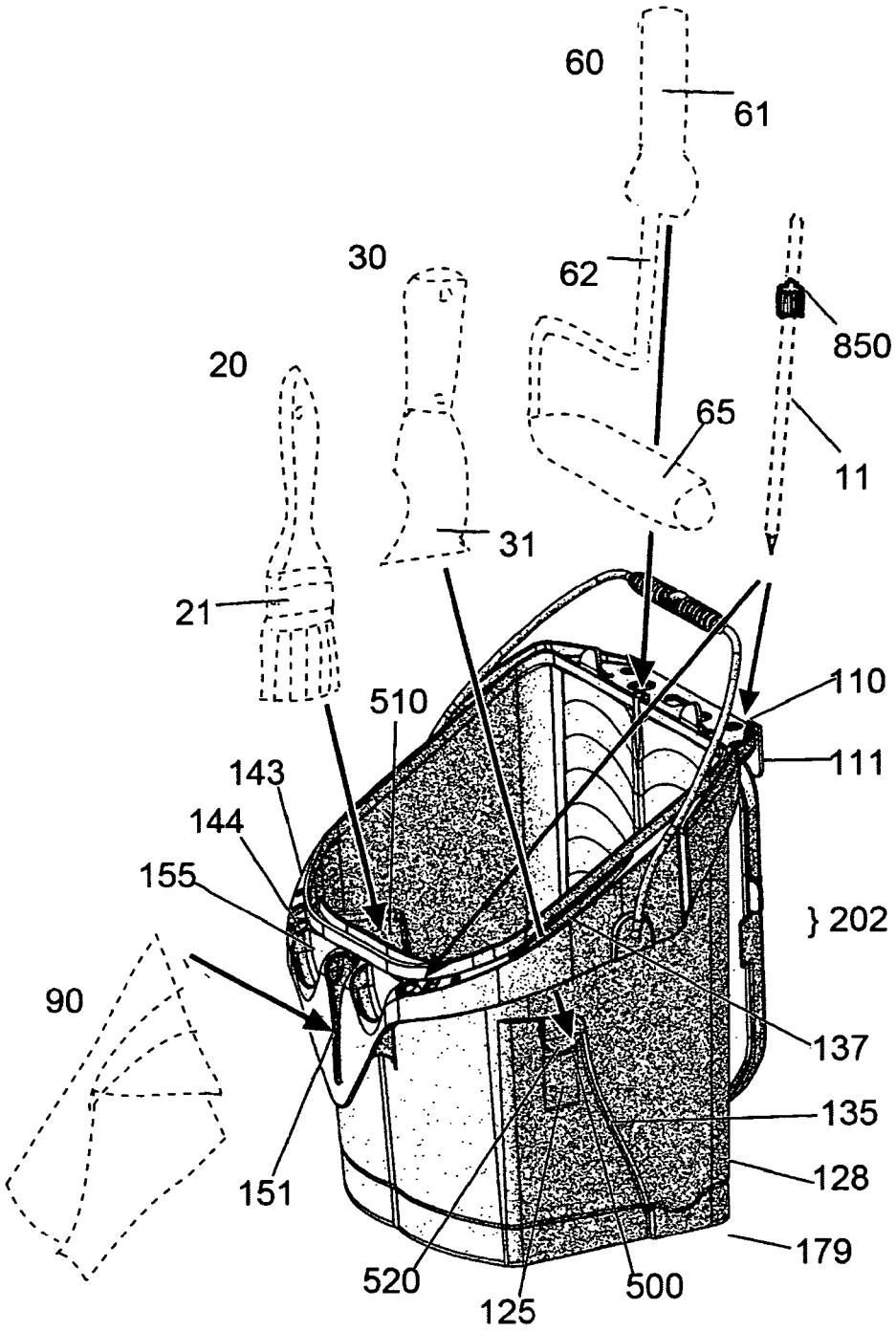
FIG. 2. Front prospective view of the invention showing various associated tools and tool stowage locations.

A preferred embodiment of the present invention, as disclosed in FIGS. 1 and 2, can comprise a container unit 100 with a flange 103 around an open top 180. The flange 103 can comprise a plurality of tool receiving holes, pockets and slots 112, 113, 114, 116, 144, 151, 155. Special 'T' shaped slots 115 can be provided to receive corresponding tabs 230 on the lid 201.

A preferred embodiment may also comprise various additional elements, which can comprise: a lid assembly 200, a pivoting handle assembly 400, a paint spreading grid or screen 70, a carrying strap 700, a removable liner 800, and a tool storage collar stop 850.

In a preferred embodiment, the invention can be laterally symmetrical about a vertical plane passing through the middle of the invention, this provides for complete ambidextrous functionality and can contribute to providing an ergonomic conceptual simplicity.

The container 100 can be capable of holding a quantity of liquid in a reservoir area 101 and/or a plurality of tools on a flange 103. The container can have a rear substantially planar wall 160 that is oriented in a near vertical position when the container is sitting on its bottom and resting normally on a horizontal surface.

There can be an open top side 180 which is at least partially surrounded by a substantially horizontal flange 103 protruding outward from near the top edge of the open top side 180. The flange 103 can contain holes 113, 114, 116, 119, 144 and/or recesses 155 for receiving putty and holding a tool or a plurality of tools. Portions of the tool flange 103 may be substantially vertical, like the side flange 133 and the rear flange 111. The side vertical flange 133 can be configured to hold a tape measure or similar clip-on item, including among other possibilities, a tool-holding pouch.

In an exemplary preferred embodiment, the top opening 180 can slope downward towards the front at an angle of approximately 30 degrees from the horizontal.

A preferred embodiment can comprise a lip 108 extending vertically upward around the periphery of the open top 180 when the container 100 is resting on a horizontal surface. The lip 108 can be capable of receiving a semi-sealing lid assembly 200. In contrast to the prior art for clip-on lids, the lip of the present invention may be vertical while the open top is inclined at approximately 30 degrees from horizontal. Thus removal of the lid occurs in a vertical direction 970, rather than perpendicular to the surface of the open top and lid as is found in the prior art.

The container unit 100 can be molded from a semi-flexible plastic such as high-density polyethylene or polypropylene, and formed with four substantially planar walls: a rear wall 160, two side walls 130; a front wall 140; as well as a bottom 170 and an angled open top 180. An outwardly protruding flange 103 can be provided around the periphery of the open top 180. A vertical, upwardly protruding lip 108 can also be provided around the periphery of the open top 180. The lip 108 can be configured to receive a sealing or semi-sealing lid assembly 200 with suitably shaped extensions 204, 203.

Radiused corners 128 of approximately ½ inch radius can be provided where the side walls 130 meet the rear wall 160. When viewed from the top (FIG. 3), the reservoir portion 101 of the container unit 100 can have a trapezoidal shape where the side walls 130 are of equal length and the rear wall 160 is longer than the front wall 140. The side walls 130 will therefore be non-parallel. This feature can provide for more compact storage within a round storage space as may be found within a standard five-gallon paint pail. An object of the present invention is to constrain the dimensions of the container such that the complete apparatus can be stored entirely within a closed standard five-gallon paint pail.

As shown in FIG. 2, the present invention provides a painter with convenient means of transporting and accessing a supply of paint and associated tools such as: a paint roller tool 60; a paint brush 20; a scraper tool 30; a pencil 11; and a wiping cloth 90. A paint roller tool 60 can be hooked on the rear lip 108 of the container 100. A paint brush 20 can be held by a magnet 500 attracted to the brush's metal band 21 near a location 510 on the interior of the container 100. The magnet 500 can be located in a pocket 550 in the side wall 130 of the container 100. A putty knife or paint-scraping tool can be held by the combination of a magnet 500 on its outside edge 520 and an oblong hole 137 in a tool-holding flange 103. A vertical portion 133 of the tool-holding flange 103 can be provided proximal to the outer side of tool hole 137. The vertical portion 133 proximal to hole 137 provides a handy element to clip on a tape measure or a clip-on tool-holding pouch.

Figure 16:
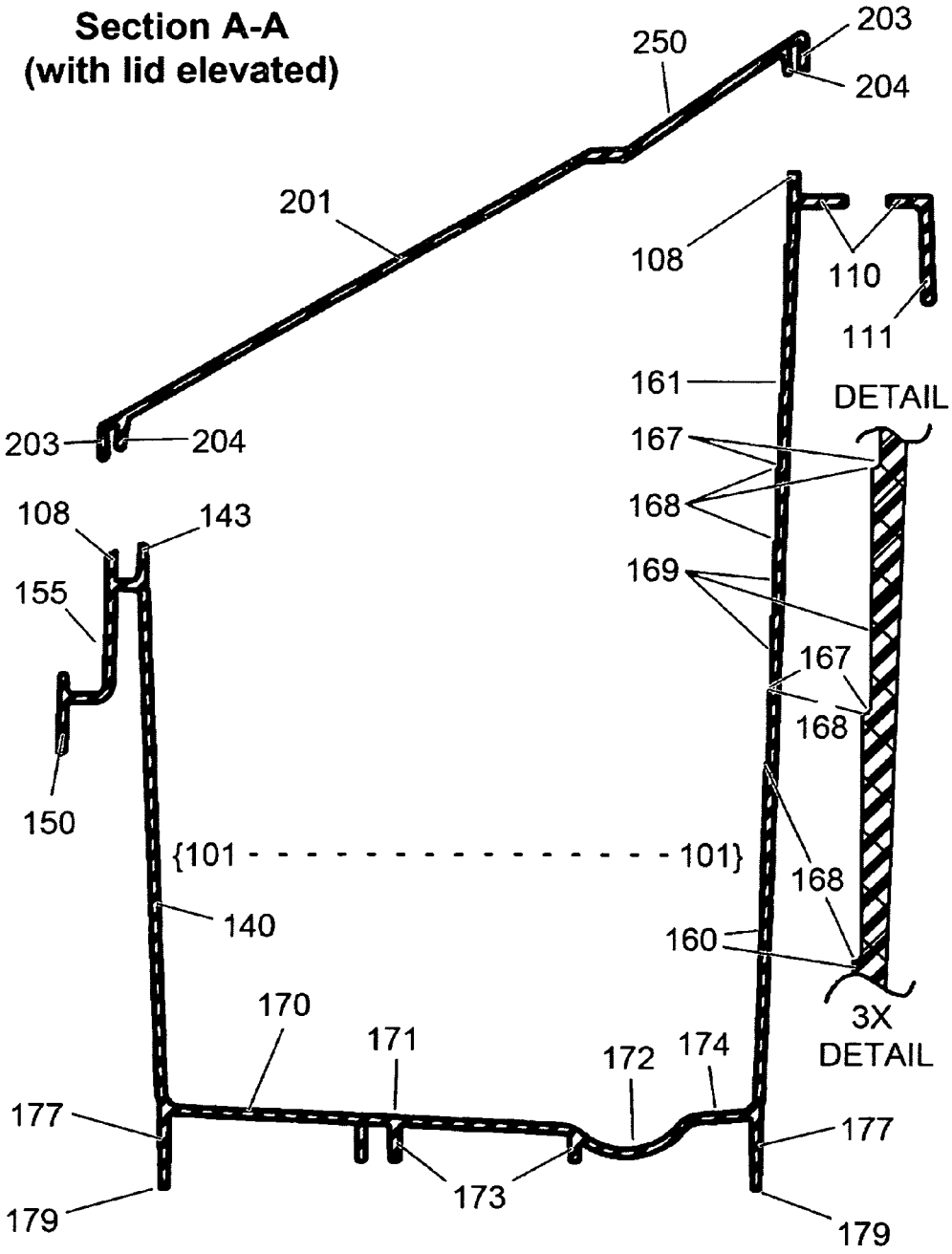
FIG. 16. A cross sectional view taken on a vertical plane A-A in FIG. 15, shown with the lid elevated.

With reference to FIGS. 1 & 16, the interior surface of the rear wall 161 can be provided with a textured surface 162. A detail view of the texture pattern is shown in FIG. 16. The texture can be in the form of a pattern of approximately horizontal ledges 168 that extend approximately 0.025 inch into the reservoir area, then have an approximately vertical downward section of about 0.8 inch 169, then another approximately horizontal ledge 168. A radiused fillet 167 of approximately 0.025 inch radius can be provided in the concave corner where a ledge 168 meets a face 169. This radius can make the textured pattern easier to clean while maintaining traction on the roller. The net horizontal offset per ledge including the fillet can be approximately 0.025 inches.

When seen from the front, the ledges 168 can form a series of laterally symmetrical curves that have outer sections that form an upwardly convex curve of approximately 2.5 inch radius, said curves meeting along the invention centerline in a slightly rounded vertex 165, with an upwardly concave radius of about ½ inch. This pattern of ledges can provide extra traction for the roller as it is rolled on the container's substantially planar rear wall. This pattern is provided as a backup measure. For optimal performance, a separate paint spreading screen or grid 70 is provided by the invention.

The paint-spreading screen 70 of the present invention provides a combination of improvements over the prior art. In a preferred embodiment the paint-spreading screen 70 is a substantially planar assembly without any hooks on its top side 71. Hooks on the top edge are the norm in the prior art. Hooks are a versatile means of securing a screen in a variety of buckets, but the hooks tend to interfere with installing a sealing lid 200 on the container. The lid 200 can be useful for temporary storage of paint and painting equipment 60, 20, 30.

Figure 17:
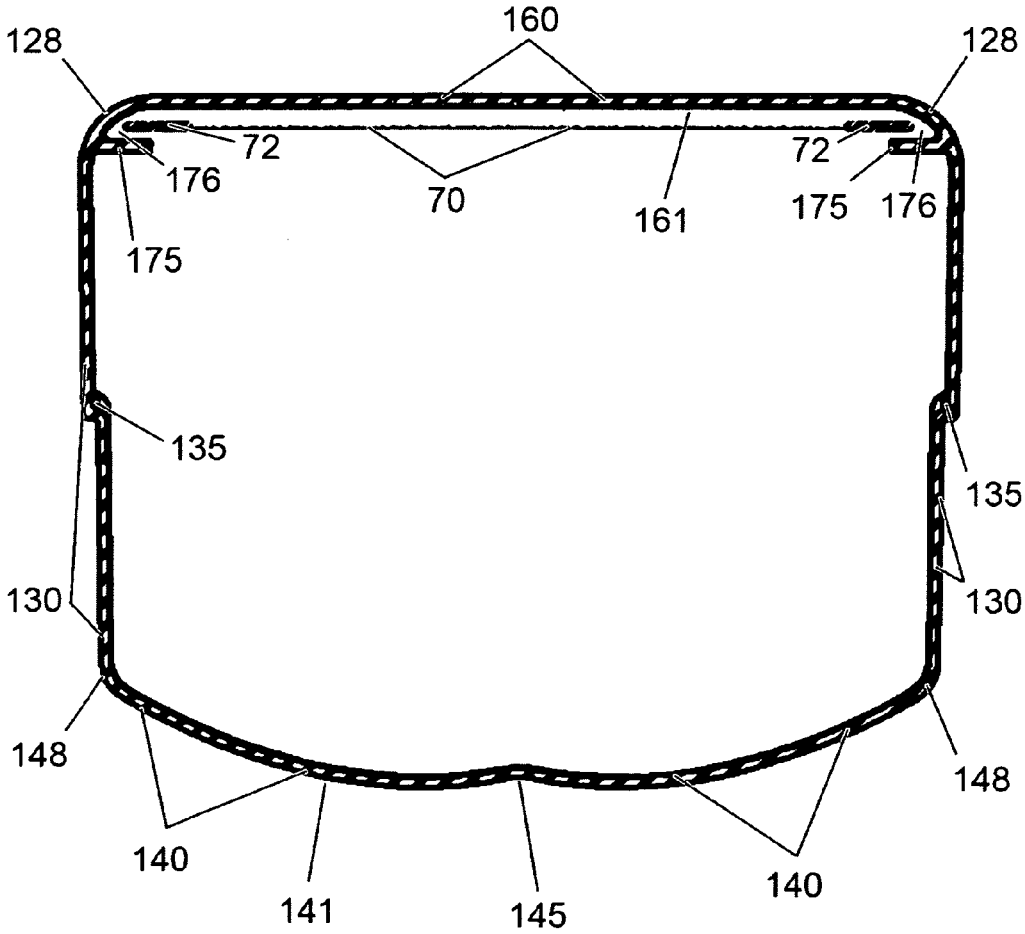
FIG. 17. A cross sectional view taken on a horizontal plane B-B in FIG. 15, shown with the paint spreading screen in place.

In a preferred embodiment of the present invention the paint spreading screen is engaged to fit securely in place within the container 100 by means of two slots 176 formed into both side walls 130 of the container in their respective lower portions. The slots 176 can be formed by the combination of inwardly protruding webs 175 on the side walls and the interior surface of the rear-side corner wall 128. The slots 176 can engage the side beams 72 in their lower portion 73 and the spreading screen assembly 70 is positioned in place as shown in the cross sectional view of FIG. 17; the position being nearly parallel to and slightly offset from the rear wall 160 of the container 100. Depending on the qualities of the liquid being rolled and the roller nap, an appropriate offset could be ⅛ inch at the bottom 75 and somewhat less at the top 71 of the screen 70.

To position the screen 70 in an effective and secure position it can be desirable to provide the lower portions on the screen side beams 73 with a slight curvature 74, which is concave to the side facing rearwards. This curvature 74 can easily be adjusted by hand bending of metal side beams 72. The top 71 and bottom 75 edges of the screen benefit from deburring, but do not generally require supporting beams.

A pivoting bail type handle assembly 400 with special stop elements 117 can be provided by the present invention. The handle can be configured to pivot from a hole 122 in the container 100 vertical side flange 133, along a pivot axis 415. The handle can have a suitable bail 405 length such that the handle grip 410 will swing clear of the lower end of the cloth-holding flange 152 when swung forwards and down for stowage. At the other extreme of its swing travel the bail portion 405 of the handle assembly 400 can be configured to engage stop elements 117 on the container's outward side flanges 132.

By engaging the stops 117, the grip element 410 of the handle assembly 400 is positioned in a location approximately three inches above the corner defined by intersection of the horizontal rear flange 110 and the vertical rear flange 111. In this position, the combination of the handle grip 410, the bail 405 and the two rear flanges 110, 111 can form an ergonomic hand hold for gripping the invention, as depicted in FIG. 1.

Figure 3:
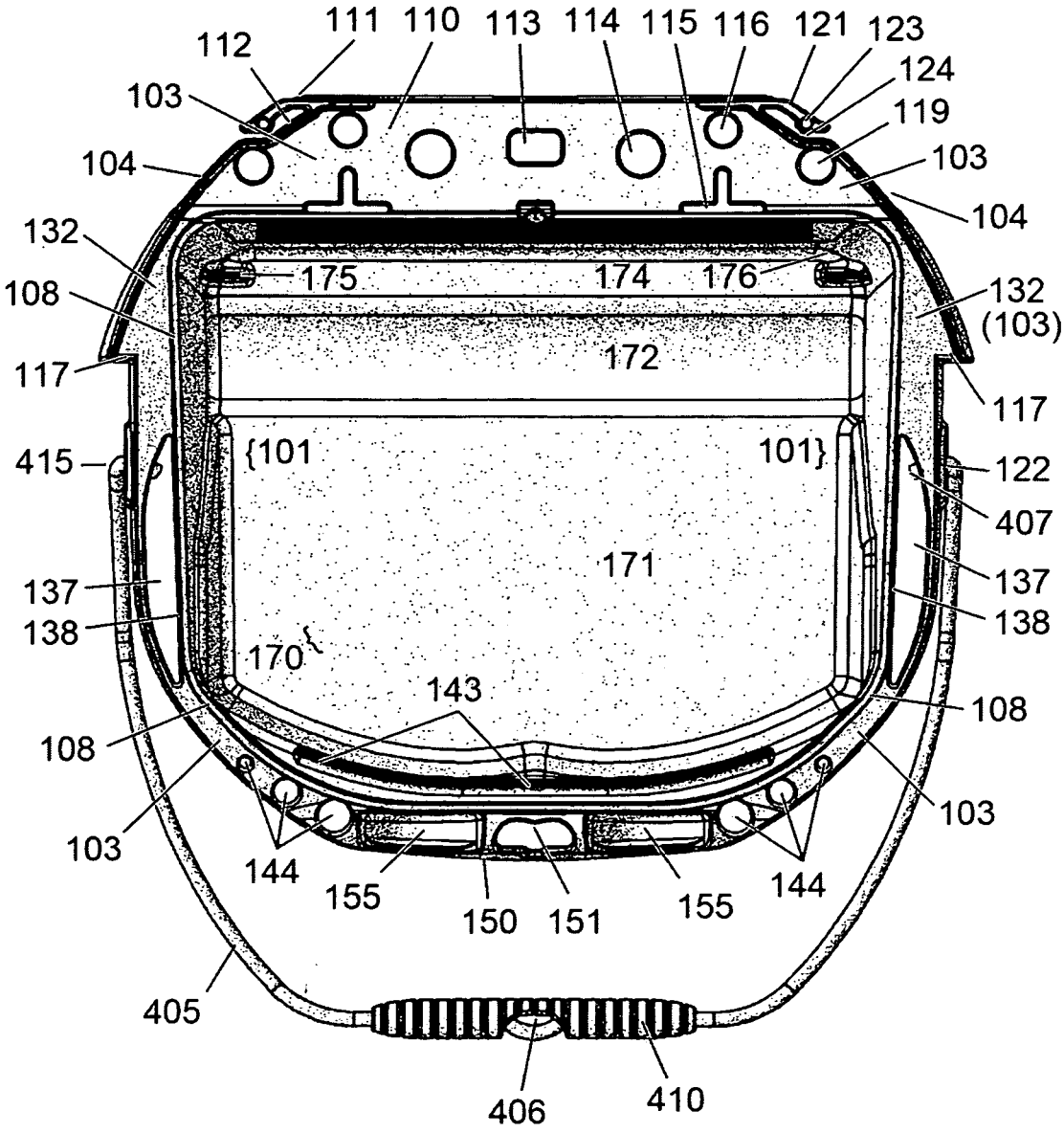
FIG. 3. Top view of a preferred embodiment of the invention showing tool stowage flange, grid support web, etc., with the handle and grip in a forward position.
Figure 7:
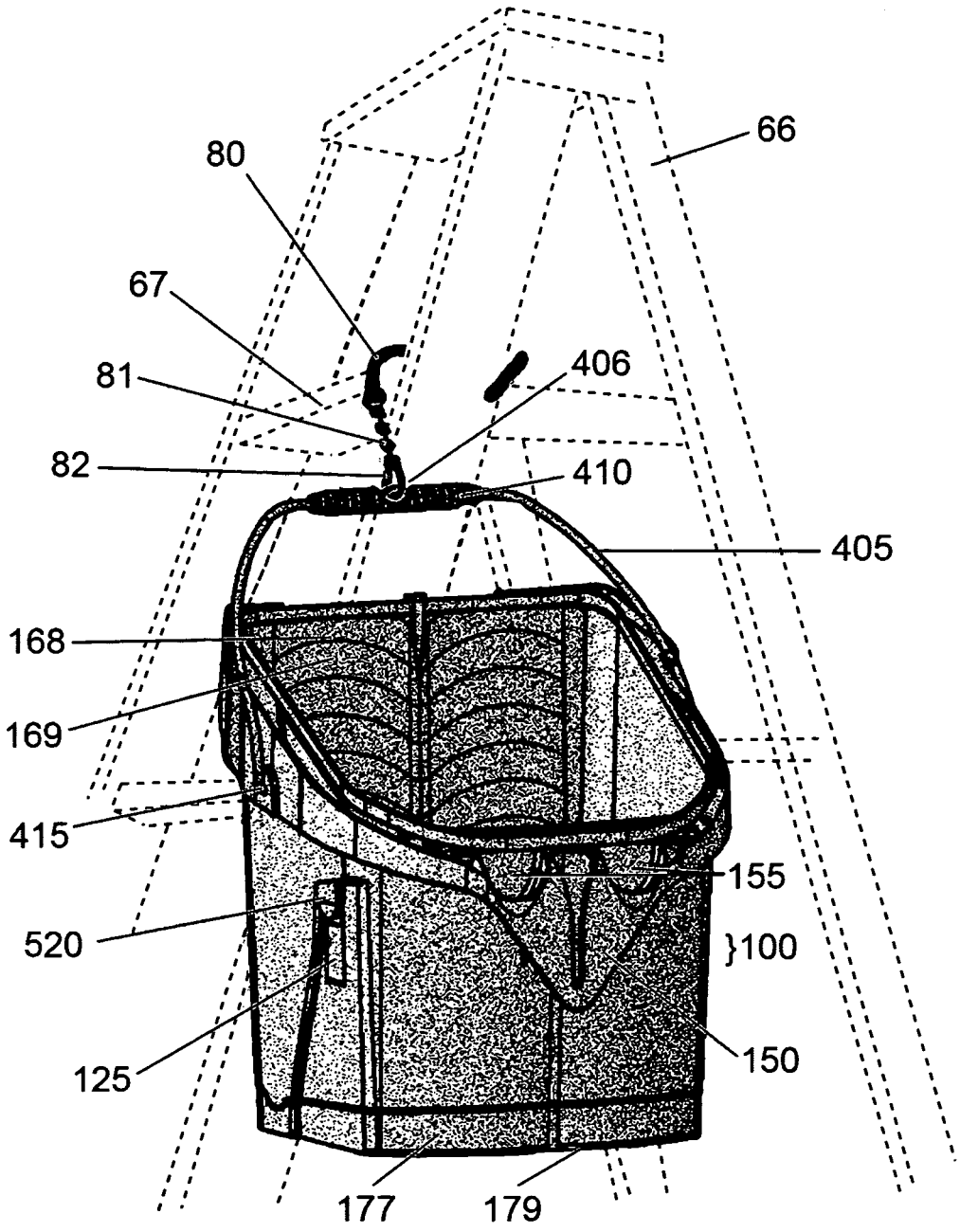
FIG. 7. Perspective view showing the container invention suspended with a hook from a ladder rung.
Figure 8:
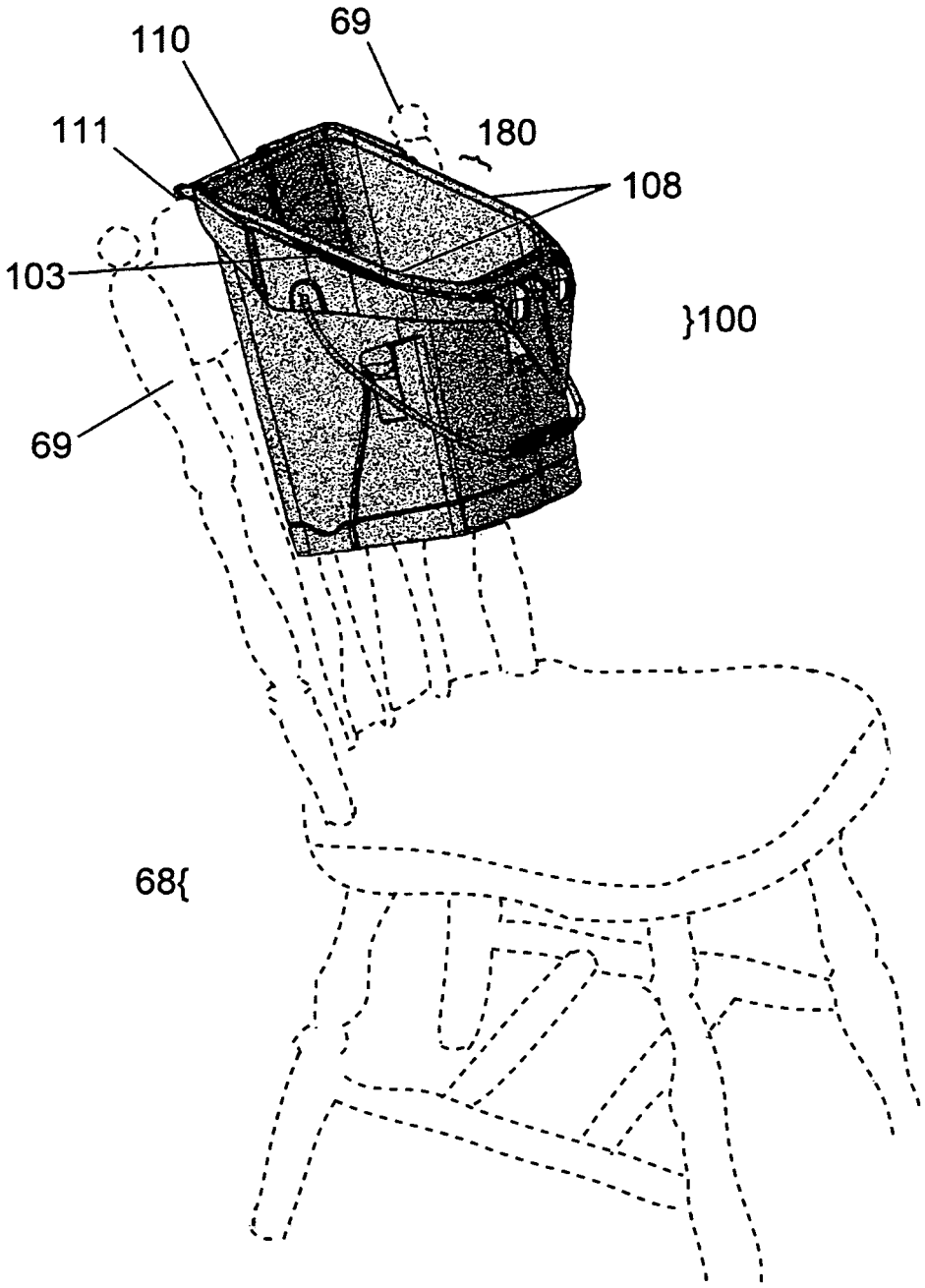
FIG. 8. Perspective view showing the container invention suspended on a chair back.

With reference to FIGS. 3 and 7, a preferred embodiment of the present invention can be provided with a pivoting handle assembly 400 formed partially of a rigid material such as wire 405, and with a resilient enlarged diameter gripping portion 410 in its central section. The central bend in the handle bail element 405 and a cutout 411 in the resilient grip element 410 form can an opening 406 configured to provide convenient means of securely attaching a detachable connector 82 to the handle near its middle. The detachable connector 82 may be integrally joined to a flexible element 81 and to a ladder hook 80, which enables suspending the container 100 from a ladder rung 67 or other structural member. Alternately, the connector 82 may be joined to a hoisting element such as a cord or rope for securing or elevating the container invention.

A preferred embodiment of the present invention can be molded from a semi-flexible thermoplastic such as polypropylene and polyethylene. To reduce manufacturing costs and facilitate injection molding, it can be desirable to taper the walls 130, 140, & 160 inward as one moves downward from the open top 180. An inward taper of 2 degrees on each wall has been employed in several embodiments. On the inner face 161 of the rear wall 160 the faces 169 of the pattern can be angled to avoid undercut pulls in the molding process. To assure this, the length of the ledge portion 168 of the pattern can be less than the tangent of the overall wall taper or draft angle times the height of the substantially vertical face 169 between ledges 168. Since the sine of 2 degrees is approximately 0.035 the ledges 168 would need to be less than 0.028 inches wide if separated by a face height 169 of 0.8 inch (0.035"×0.8">0.028").

As shown in FIG. 3, the bottom 170 of the container 100 reservoir area 101 can be divided into three areas: a front gently sloping plane 171; this plane drains rearward into a recessed cylindrical well 172, which can be sized to fit a paint roller element 65; and also a small rear flat area 174 which can drain forward into the roller well 172.

Figure 13:
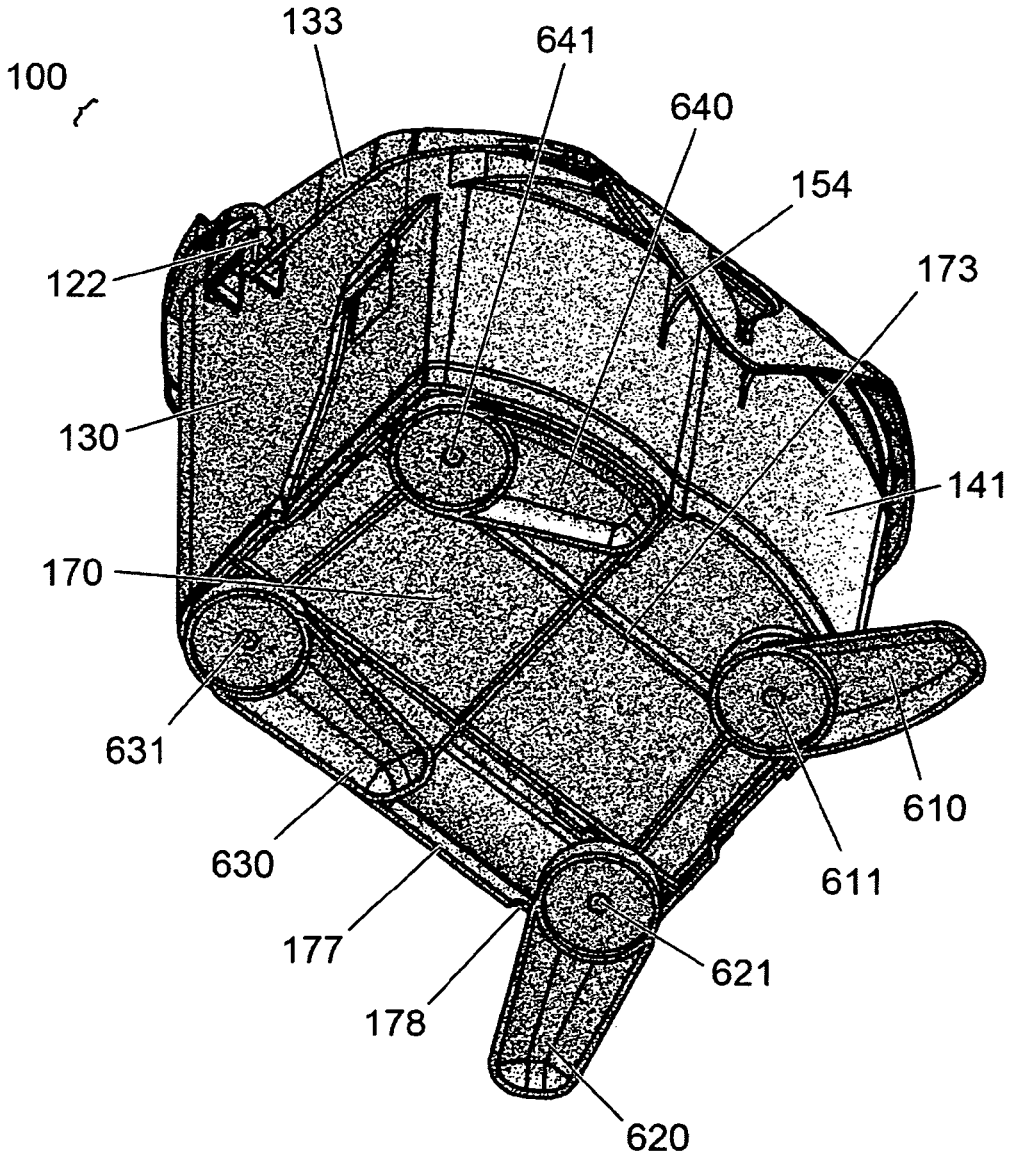
FIG. 13. A bottom perspective view, showing an embodiment of the invention with pivoting legs in retracted and extended positions.
Figure 14:
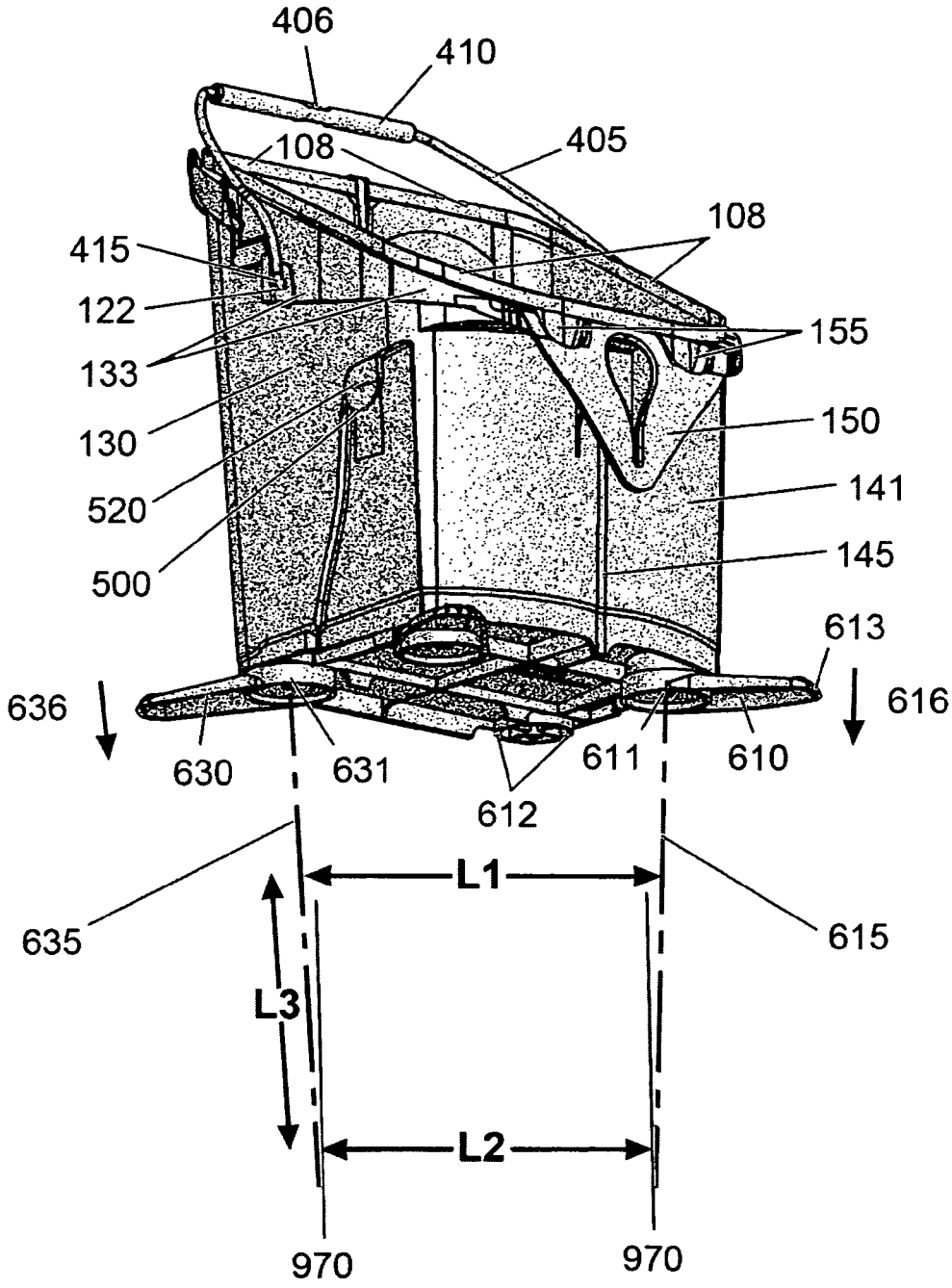
FIG. 14. A lower perspective view showing the preferred non-parallel axes of diagonal leg pivots.

The bottom 170 can be provided with various downwardly extended stiffening webs 173. The webs 173 can beneficially radiate outward from a central boss point 190 where plastic can be injected into the container mold. A downward tapering flange web 177 can extend down from around the periphery of the bottom 170. In an embodiment with legs, cutouts 178 can be provided in the bottom flange 177 for legs 610, 620, 630, 640 to protrude, as shown in FIGS. 13 & 14.

In a preferred embodiment depicted in FIGS. 1, 9, 11 and 17, the front wall of the container can be formed of two outwardly convex cylindrical surfaces 141 that meet in a near-vertical central indentation 145. The indentation 145 can provide for additional strength as well as clearance for using the cloth holder 151. The curvature of the surfaces 141 can help to provide a compact shape for the invention, allowing it to be placed within a five-gallon pail for transportation.

In a preferred embodiment one of the tool-holding areas 151 is configured to retain a cleaning cloth 90. The form of the cloth holder 151 can be a curved and approximately 'V' shaped hole in a downwardly turned portion 150 of the invention's tool-holding flange 103. In the lower part of the 'V' notch 153 the sides of the holder can beneficially become parallel or nearly so, to prevent the cloth 90 from working upward and falling out.

In a preferred embodiment, a portion of the tool-holding flange 103 can have receiving pockets 155 configured to hold a quantity of painter's putty, the putty holding areas can be formed by a pair of shallow recesses 155 located symmetrically on the front flange 150 of the container. For extra strength and rigidity, supporting webs 154 can be provided between the container front wall 140 and the front flange 150.

Figure 20:
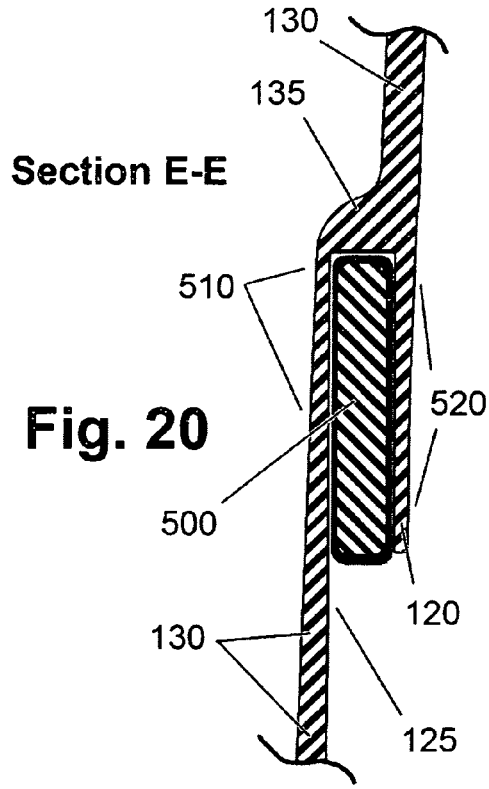
FIG. 20. A front detail cross sectional view of a magnet within a side wall of the container, taken on a vertical plane E-E in FIG. 15.
Figure 21:
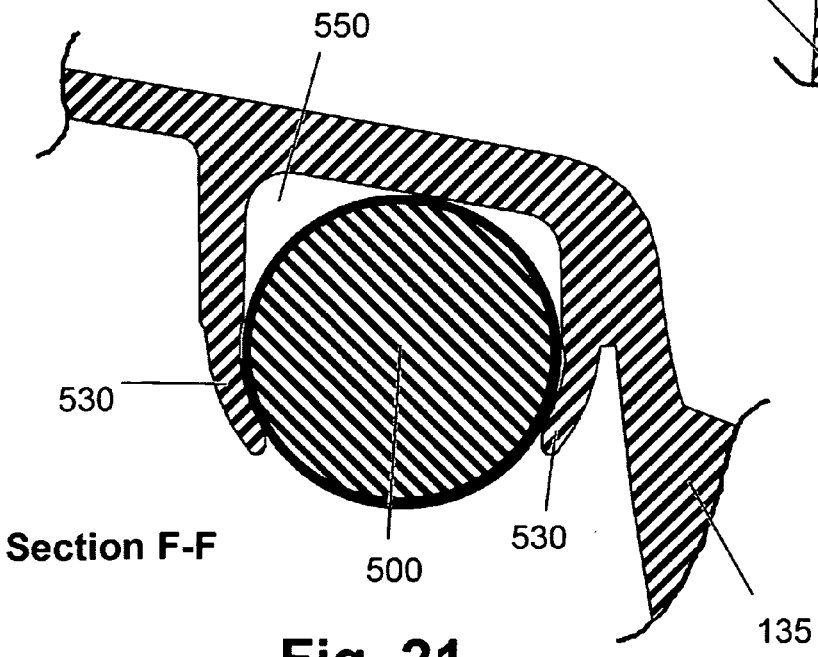
FIG. 21. A side detail cross sectional view of a magnet within a side wall of the container, taken on a vertical plane F-F in FIG. 15.

As shown in FIGS. 20 and 21 a magnet 500 can be enclosed within a magnet pocket 550 located in each side wall 130 of the container 100. Two tapered, downwardly pointing, free-hanging, extensions or ears 530 can be provided proximal to, or within, each magnet pocket 550 to hold the magnet 500 firmly in place after the magnet 500 has been inserted from below along the magnet insertion trough 125 and popped into place within the magnet pocket 550. The outer wall of the magnet pocket 550 can be formed by a thin plastic extension 120 of the container 100 body; extension 120 can have an outer face 520. The free-hanging nature of the ears allows them to flex as a magnet 500 is inserted and also flex as an injection molded plastic part ejects from the mold.

Figure 9:
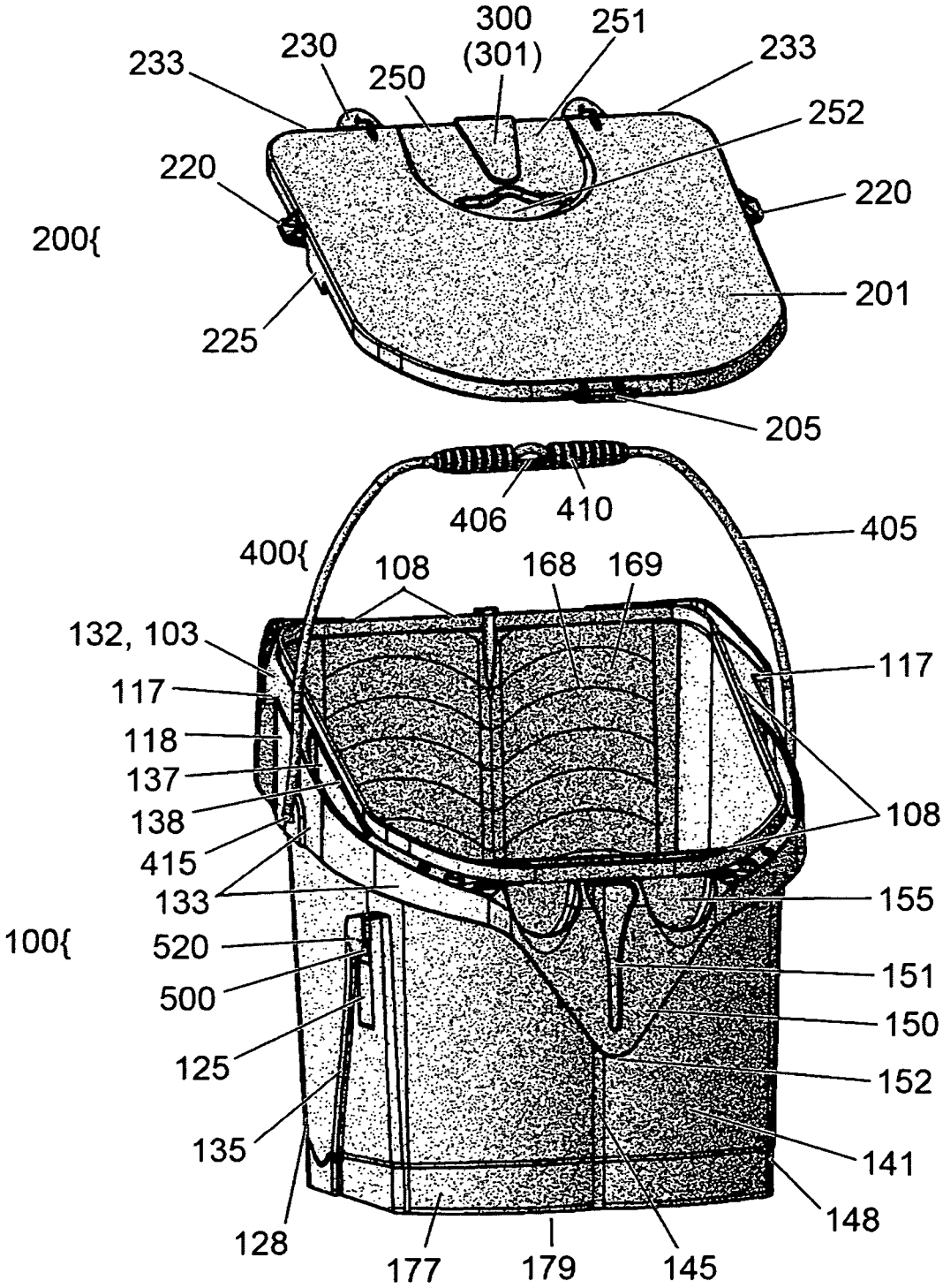
FIG. 9. Front perspective view showing a preferred embodiment with elevated lid and vertical handle position; a notch-sealing flap in lid is shown closed.
Figure 10:
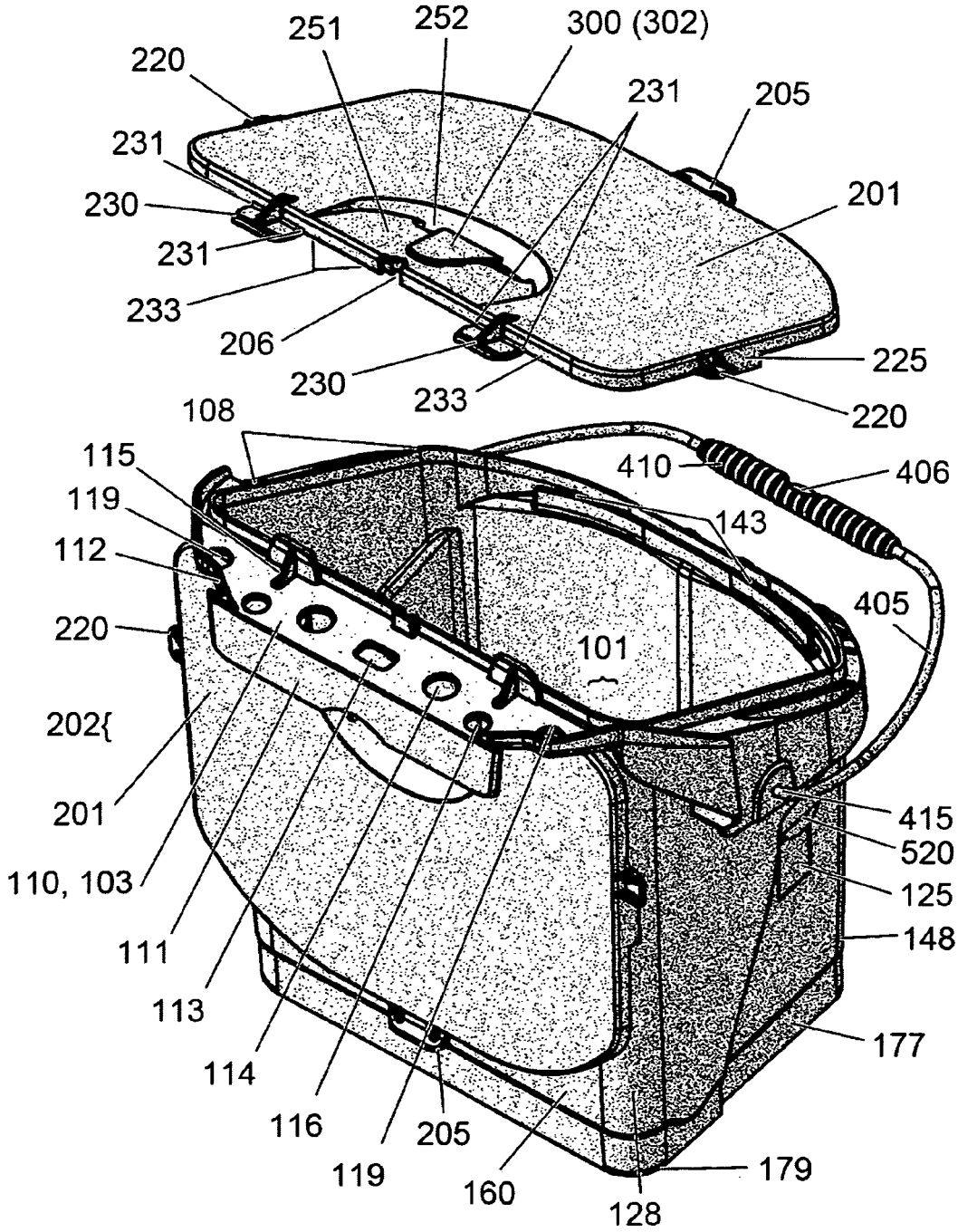
FIG. 10. Rear quarter perspective view showing the lid elevated and also alternately, the lid in a rearward stowed position, bail handle forwards; the notch-sealing flap in lid shown open.

As shown in FIGS. 9, 10, 11 and 12, a lid assembly 200 for the container 100 can be provided in a preferred embodiment. The lid assembly 200 can be equipped with a notch 206 in the back edge 233 of lid element 201. Edge 233 can be configured to engage the rear side of the open top 180. The top of the rear wall 160 of the container can have a small downwardly extending notch 106 that aligns with the lid notch 206 when the lid 201 is closed in place. The lid 201 can additionally be provided with two tabs 230 on the back edge 233. In addition to providing lifting tabs for removing the lid, the tabs 230 can be configured to slip into slots 115 in the horizontal portion 110 of the container rear flange. The tabs 230 can have narrowed areas 231 proximal to where they join to the lid 201. The narrow areas 231 can snap into place when the snugly-fitting tabs 230 are fully inserted into the slots 115 in the rear flange 110. The lid assembly 200 is given the identifying number 202 when in its rear stowed position, as shown in FIG. 10. The lid assembly 200 can be configured to engage an angled open top 180 on the container 100; the angled open top 180 can be fitted with a vertical upwardly extending lip 108 around the periphery of the open top 180. The lid assembly 200 can engage the container lip 108 in a vertical direction 970.

The lid assembly 200 can comprise a substantially vertically downward extending pair of lips: an outer lip 203, and an inner lip 204; these lips can be configured to mate with the upwardly extending lip 108 on the container 100 thus forming a substantially vapor-tight seal between the container 100 and the lid 201.

The slot 207 between the inner lip 204 and outer lip 203 of the lid 201 may beneficially comprise a wider gap at the base of the slot 208 and have a narrower gap at the entrance to the slot 209; the gap width near the entrance 209 can beneficially provide a snug fit on the container flange 108.

The container flange 108 may have parallel and vertical wall sides formed with considerable precision, so as to fit well in the slot 207 of the lid element 201. For a snug fit, the gap at the entrance to the slot 209 can be slightly smaller than the thickness of the container flange 108; 0.002" to 0.005" of interference fit may be found sufficient to assure a snug seal. The gap at the base of the slot may beneficially be wider than the width of the container flange 108 plus twice the thickness of a removable liner 800. With this dimensional form the lid lips 203, 204 can flex and allow said container lip 108 with a liner 800 installed to be inserted all the way into the base 208 of the lid lip slot 207.

Because of this widening of the gap towards its base 208, the mold surfaces forming the slot 207 may experience an undercut or reverse draft situation. To allow the lid 201 element part to eject from the mold it can be beneficial to put compensatingly large amounts of positive draft on the face 210 of the inner lip opposite to the slot face. The outer face 211 of the outer lid lip 203 can be formed by a second section of mold that joins to the first section containing the lid slot 207 forming plug. As the two mold sections separate, the lid part 201 can stay with the lid slot plug until the outer face 211 of the outer lip has cleared its second mold section. Once clear of this second mold section the outer lip 203 can flex and come off of the lid slot forming plug incorporated in the first mold section.

The lid element 201 may beneficially be molded from a semi-flexible thermo-plastic such as polyethylene. The plastic used for the lid 201 may beneficially be softer or more flexible than the plastic used to mold the container element 100.

A typical wall thickness of approximately 0.090 inches can be used in preferred embodiments of both container and lid.

Figure 11:
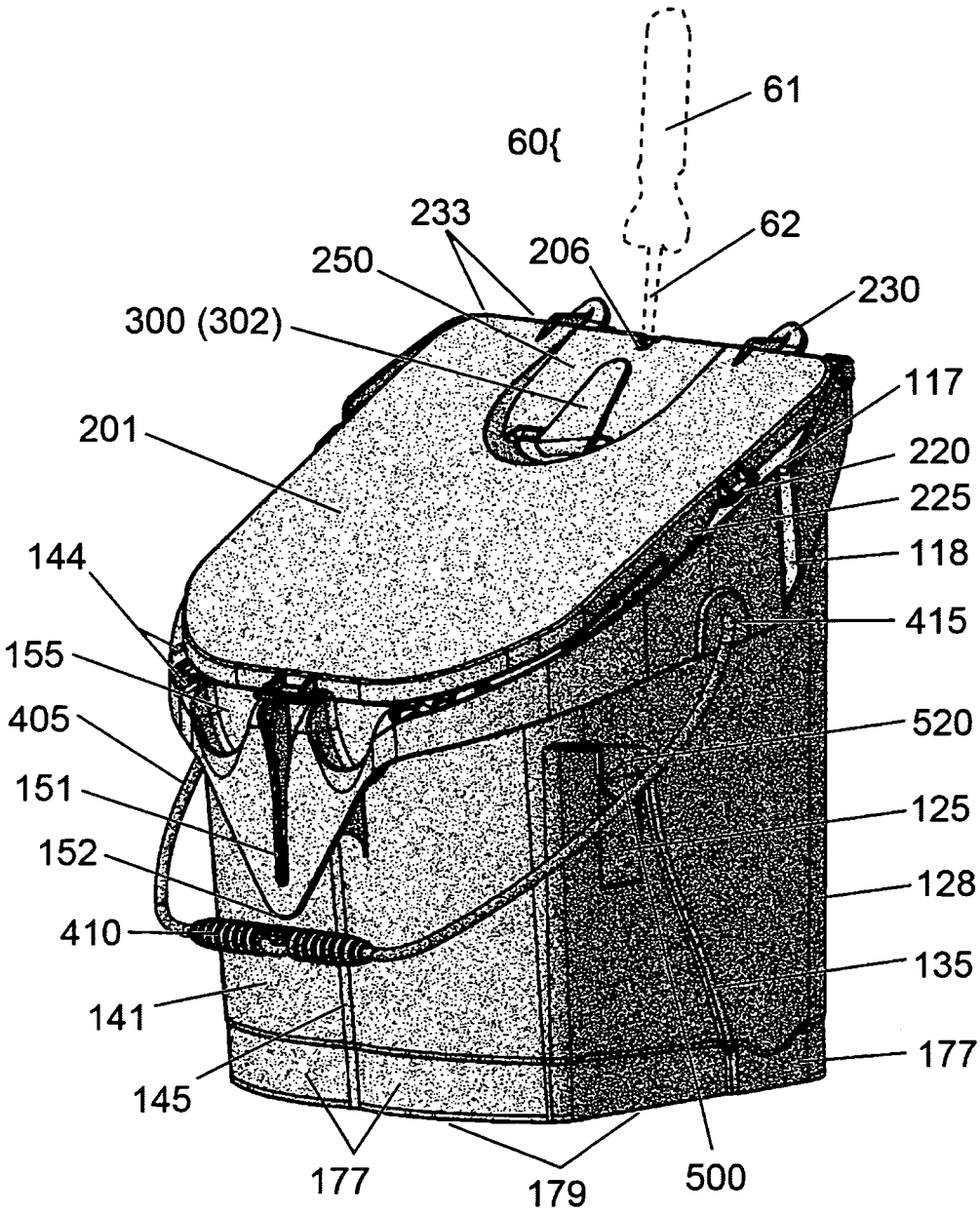
FIG. 11. Discloses a front perspective view of the invention, with the lid in the closed position and a paint roller tool in storage position; the notch-sealing flap in the lid is shown open, to accommodate the roller tool handle shaft.
Figure 12:
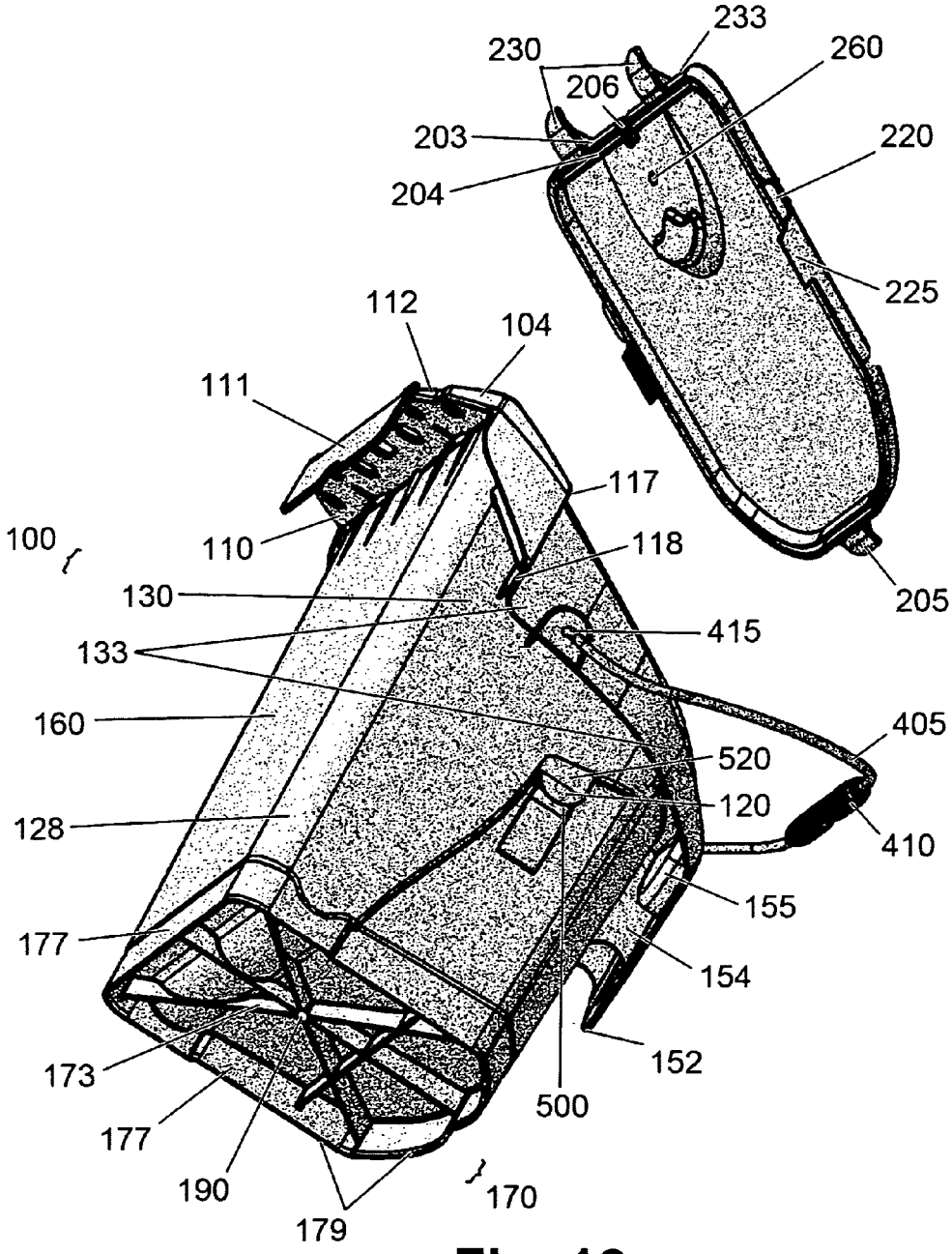
FIG. 12. A bottom perspective view of the invention, showing the lid elevated and the handle forward.
Figure 19:
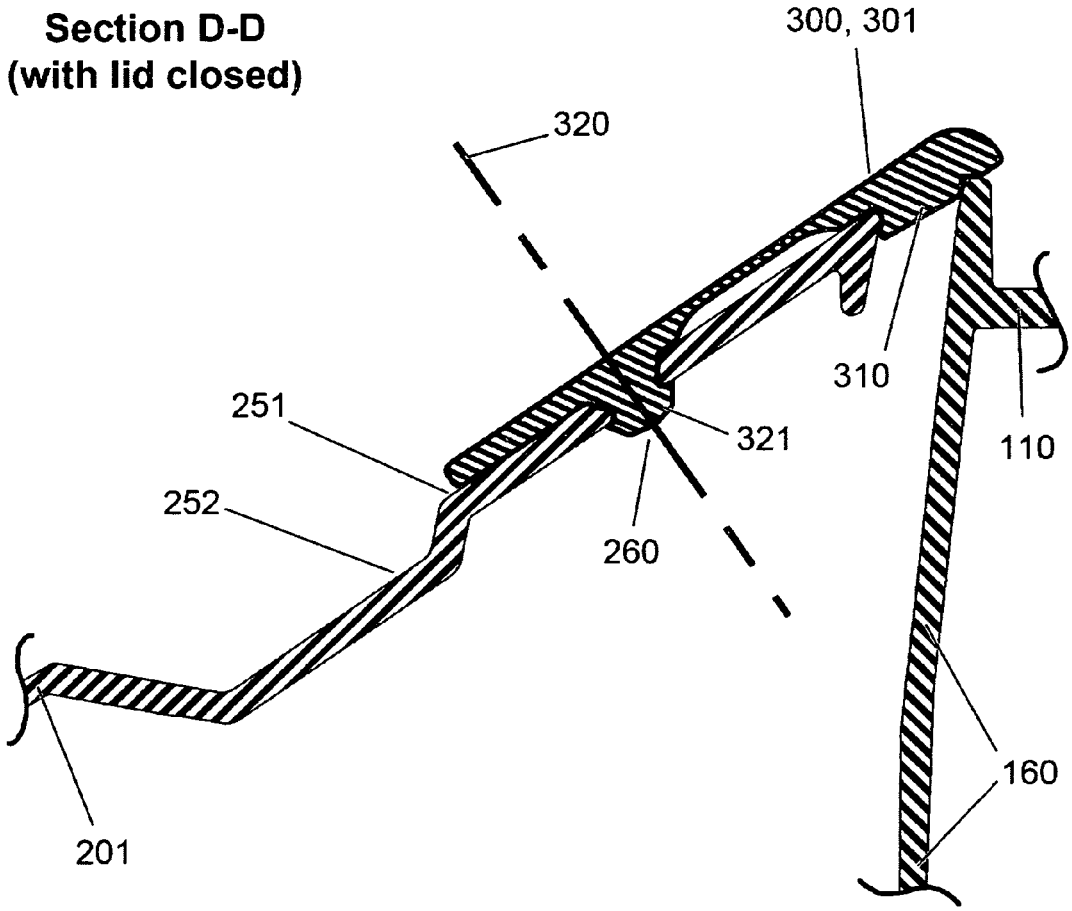
FIG. 19. A detail cross sectional view of the lid, flap and container taken on a vertical plane D-D in FIG. 15, shown with the lid closed and the lid flap closed, this view is taken on the vertical mid-plane of the invention's symmetry.

As shown in FIGS. 9, 10 and 11, the lid assembly 200 can be fitted with a moveable flap 300, said flap 300 being configured to movably cover a notch 206 in the lid when no roller tool shaft 62 is in place. This would maintain a substantially vapor-tight seal when the lid is closed without a roller tool 60 filling the hole formed by the container notch 106 and the lid notch 206. The flap 300 can beneficially be joined to the lid 201 by means of a pivot 321 with an axis 320 as shown by sectional view in FIG. 19. The flap element 300 can alternatively be molded as part of the lid 201 with a flexure attachment between flap 300 and lid 201.

When pivoted away from the notch 206 as seen in FIG. 10 the protruding portion of the flap 310, which is configured to fill the notch 206, can be provided with a recess 250 in the top of the lid. The recess can have a main semi-circular section 251 and a deeper inverted tee-shaped section 252. These recesses 251, 252 can provide clearance for the flap protrusion 310 to stow without flexing the material of the flap element 300. The flap element 300 can require some flexing when going from the closed position 301 to completely open position 302.

The lid 201, when closing, can utilize protruding tabs 225, which have ridges or extensions that can engage contours at 138 along the edge of the hole 137 in the tool flange 103 around the container body 100. This would provide a 'snap into place' function. These protruding tabs 225 can extend downward from the lid 201 when it is closed in the normal resting position of the container. The tabs 225 can engage an outwardly extending ridge 138 formed by the inner edge 138 of the elongated scraper-holding hole 137 in the container's side tool-holding flange 132, 103.

The lid 201 can be provided with a plurality of tabs extending outward from the edges of the lid. Two of the tabs 230 can be configured to insert into and be held securely in correspondingly shaped holes 115 in a horizontal flange 110 extending rearwards from the main container 100 body. The tabs 230 and slots 115 can beneficially be configured to assure that the lid will lie closely along side of the rear planar wall 160 on the exterior of the container 100 when the lid assembly 200 is in a rearward stowed position 202 as shown in FIG. 10.

Figure 4:
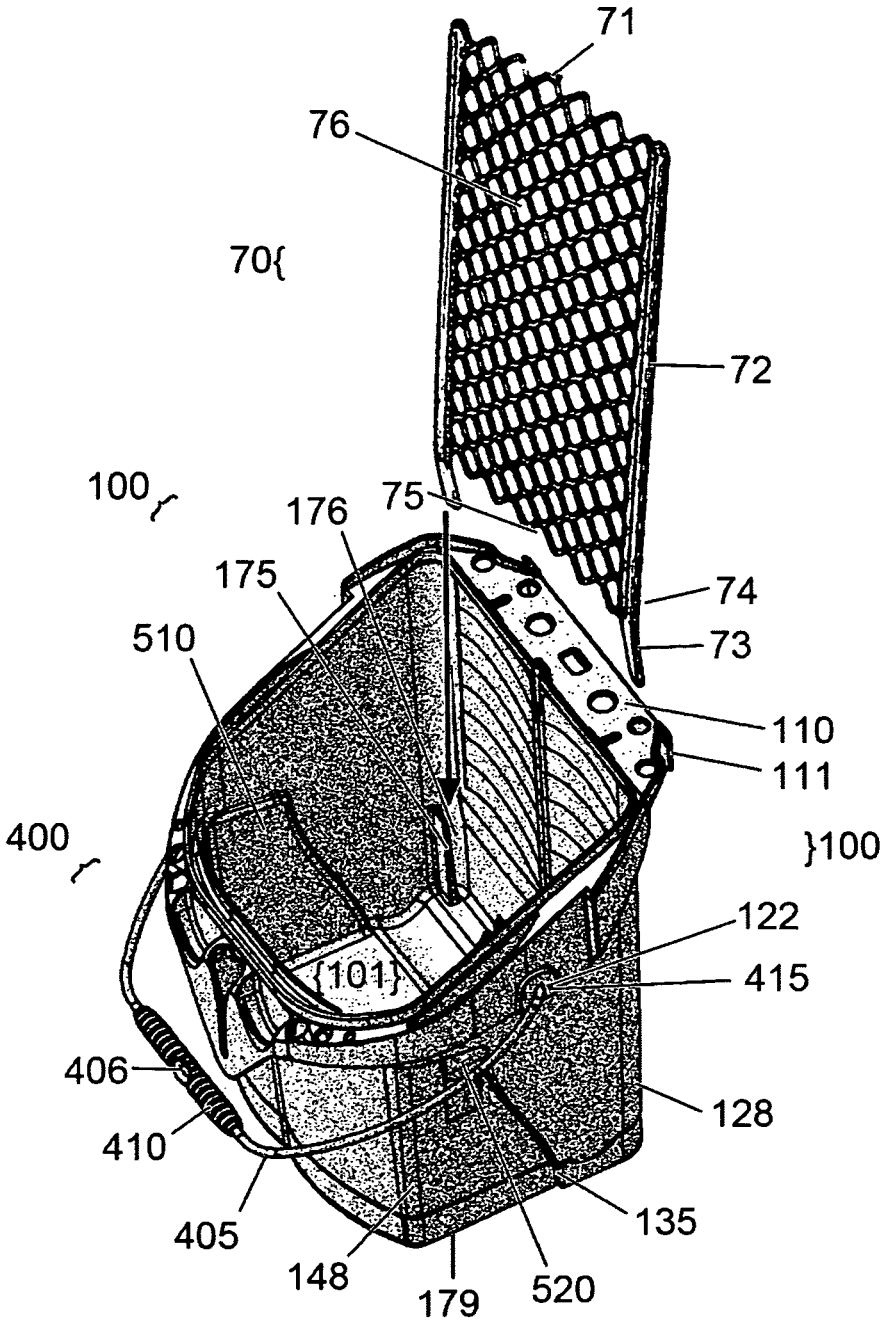
FIG. 4. Front prospective view shown with relationship to insertion of a paint spreading screen.

In a preferred embodiment shown in FIG. 4, a paint-spreading grid or screen 70 inserts to fit within a container 100, where the grid 70 can be a substantially planar element, without suspension hooks. The grid 70 can be held securely within the container 100 in a position nearly proximal to a rear planar wall 160 by slots 176 comprised into the interior of the container 100. The spreader grid element 70 can beneficially have rigid beam elements 72 on either side of a porous central element 76

The beams 72 can be configured to engage the slots 176 in the interior of the container. Slots 176 may beneficially be formed by the following combination: on one edge of the slot by flanges or webs 175 that extend approximately ½ inch inwards from the interior faces of the side walls 130 of the container 100; and on the other edge of the slot 176 by the interior surface of radiused corners 128 of the container 100.

The flanges or webs 175 can beneficially additionally perform the function of preventing jamming or locking together when multiple containers 100 are stacked for storage (without grids 70 in place). To effectively achieve this stack-defining function the flanges 175 can terminate in a substantially horizontal top edge 185 located some distance above the bottom of the container, per preferred example: if the lowest extent 179 of the bottom perimeter flange 177 is located 3.4 inches below the top edge 185 of the web 175, the stacking interval will be 3.4 inches. When stacked, the web flange 175 of a lower container will engage the bottom edge 179 of a container stacked above.

In the preferred embodiment of FIG. 4, it can be beneficial to provide a slight curvature 74 to the side beams 72 of the grid, with the concave side proximal to the nearby rear wall 160. This feature can help to position the grid more securely and place the top edge 71 of the grid element closer to the nearby rear wall 160. To allow for drainage of paint through the grid, it is beneficial to provide for some gap between the grid and the nearby rear wall 160, approximately 1/16 to 3/16 inch being found sufficient in a preferred embodiment.

In a preferred embodiment shown in FIGS. 20 & 21, magnets 500 are contained within the side walls 130 of the container 100. The magnets 500 are close to the surface of the container on both the inside 510 and the outside 520 and can therefore be capable of independently holding magnetically attractable tools 20, 30 both on the inside 510 and on the outside 520 of the container 100, near a magnet 500.

In a position approximately above a magnet 500 an additional supporting element can be provided in the form of an oblong hole 137 in the side flange 132 running along the side of the open top 180 of the container. The perimeter of this hole 137 can provide additional support for a tool 30 attracted to and held by the magnet 500 to the proximal exterior face 520.

In a preferred embodiment, the magnet-equipped side walls 130 of the container can be formed by two substantially parallel elements that are offset laterally 135 from one another by a distance of approximately 0.15 inch. This offset distance can correspond to the approximate thickness of the magnets 500 contained within the walls 130 of the container 100. The offset 135 may provide for easier molding of magnet-holding pockets 550 within a plastic container part. The offset 135 can also contribute structural integrity to the side walls 130.

The magnet pockets 550 can comprise means of securely holding the magnets in position. The form of the magnet holding means can comprise molded plastic pockets 550 within the side walls 130; the pockets 550 being substantially open on the bottom side. The pockets can be additionally equipped each with two downwardly extending, tapered, semi-flexible plastic 'ears' or extensions 530 that will hold a magnet 500 firmly in place after the magnet 500 is snapped Into position from below. The taper of the ears 530 helps to ensure that the ears 530 can separate from the mold section that forms them, by means of bending and flexing of the ears 530.

The magnet 500 can be positioned within the side walls 130 such that a relatively thin layer of non-magnetic plastic covers the magnet on both sides 510 and 520. The thickness of the covering layer may taper and can be in the range of approximately 0.015 inch to 0.030 inch. This is in order to provide sufficient structural integrity while providing for a sufficiently short distance between the magnet 500 and a magnetically attracted tool 20, 30. A short distance can assure an adequate holding force between a tool 20, 30 and a magnet 500.

To effectively hold tools, the magnets 500 can be embedded within the side walls 130 of the container 100 in a location approximately one third of the way from the front top lip 108 of the container 100 to the bottom 170, and approximately one quarter of the way from the front wall 140 to the rear wall 160.

In a preferred embodiment bi-functional magnets 500 can be utilized to simultaneously hold a paint brush 20 as well as a scraping tool 30 with the same magnet 500. In the exemplary preferred embodiment, a magnet 500 is inserted into a close-tolerance receiving structure 550 located in the side wall 130 of the container.

The offset 135 in the side wall 130 can allow the magnet 500 to have close proximity to both a paintbrush 20 on the inside 510 of the container and a scraper tool 30 on the outside 520. The offset 135 can make for easier injection molding of the magnet pockets in the container 100. For example: in this preferred embodiment an approximately 0.025" interior plastic wall between the side of the magnet and the metal band 21 around a paintbrush 20 allows a 0.75 inch diameter magnet 500 to firmly hold a brush 20. On the outside 520 of the magnet enclosure, an approximately 0.025" thick plastic skirt 120 helps to hold and enclose the magnet, defining the magnetic flux gap spacing for gripping of a scraper tool blade 31.

Figure 5:
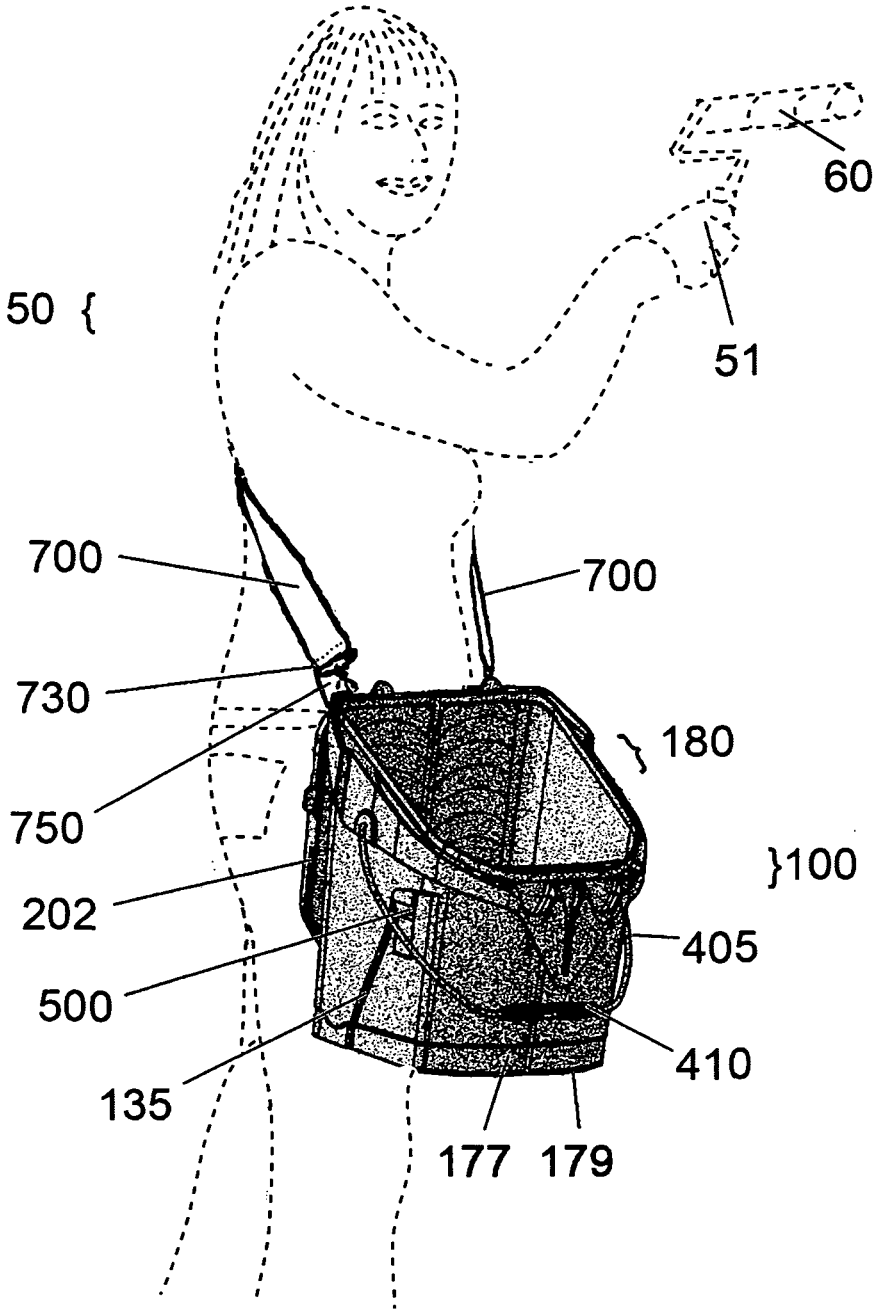
FIG. 5. Painter using a preferred embodiment of the present invention showing a preferred carrying strap configuration.
Figure 6:
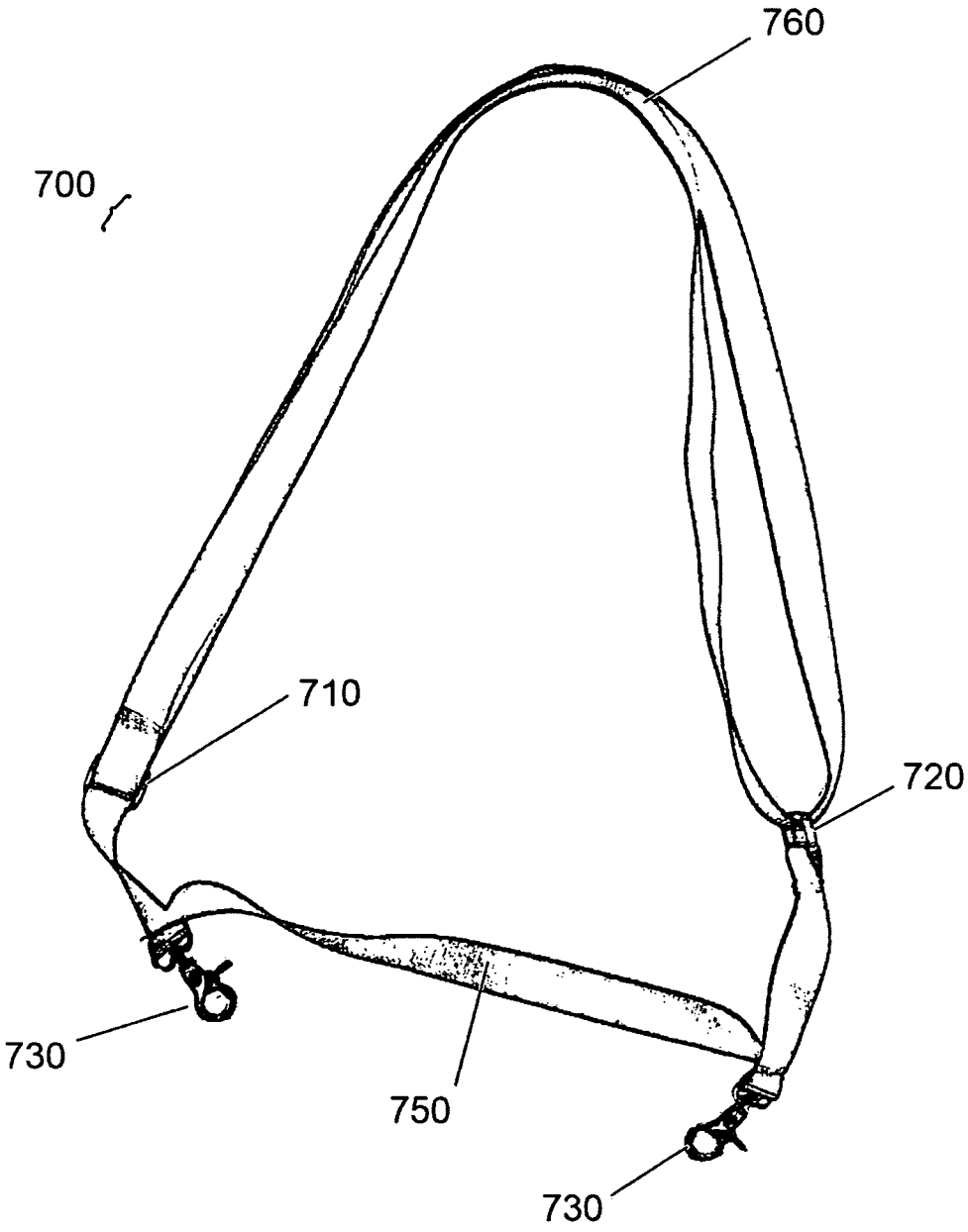
FIG. 6. Preferred embodiment of the carrying strap loop.

As shown in FIGS. 5 and 6, a carrying strap 700 can be provided by the present invention. The carrying strap 700 can be formed as a complete loop, said loop form assuring that a user 50 of the invention may securely wear the strap separately, without a container 100 attached, and not have the danger of the strap 760 slipping off the shoulders, because of loose ends. The loop form of the strap can enable a user to easily attach and detach the container from the strap element 700 by hooking the strap loop's lower portion 750 under a suitably shaped extension of the container 100 formed by a outward flange 110 joined to a downward flange 111, both flanges being near the top of the substantially planar rear wall 160 of the container 100. Additionally the substantially horizontal portion 110 of the rear flange can be provided with indentations 112 in its outer edge 104 near the corner where it meets the downward portion 111 of the flange. These indentations 112 can help to prevent the lower strap section 750 from slipping off the vertical flange 111, yet allow easy removal of the container 100 from the strap 700 when required. It can be beneficial to provide the strap loop with means of length adjustment 710, 720.

An outward extension 121 of the rear flange 111 can be provided. This extension 121 can form an enclosed area 112 which is capable of holding a strap 700 in place near a rear corner of the container 100. A narrow portion 124 of the area 112 can be narrow enough to grip a strap 700 as it is inserted into or removed from the enclosed area 112. The extension 121 can have a semi-flexible nature allowing it to flex as a strap 700 is inserted through the narrow gap 124. A hole 123 can be provided in the extension 121. By joining a hole 123 with a hole 119 with a length of cord or wire, the narrow portion 124 is effectively closed, preventing the strap 700 from being able to come out of the enclosed area 112.

The carrying strap 700 can comprise a pair of clips 730 (or snap hooks), which can be attached to the lower portion of the strap 750 in positions that enable the clips 730 (or snap hooks) to be detachably fastened to appropriate points on the container body, such as a pair of holes 119 in the rear horizontal flange 110.

As shown in FIGS. 13 and 14, a preferred embodiment can be provided with a set of retractable legs. Four legs 610, 620, 630 and 640 can be provided, each one pivoting about a point 611, 621, 631 and 641 located near each of the four corners of an approximately rectangular or trapezoidal bottom 170 on the container 100. The pivot axes 615, 625, 635 and 645 of the respective legs 610, 620, 630 and 640 can beneficially be angled in a manner providing additional stability. By making the pivot axes of the various legs converge together as the axes are extended downward additional stability may be achieved due to this non-parallel angling of the pivot axes. The ends of the legs like 613 that are distal from the container body will be lower when extended, relative to their vertical position when retracted, as shown in FIG. 14 by the arrows 616 and 636.

It is desirable to have the portions of the legs like 613 distal from their respective pivot axes flush or slightly above flush with the lowest portion 179 of the downwardly extending flange 177 that partially surrounds the bottom 170 of the container. When the legs are extended, it is desirable to have their distal portions like 613 below flush with the plane defined by the bottom 179 of the surrounding flange 177. The lower position of the distal ends 613 of the legs when extended helps to overcome any flex or slop in the leg pivots that might otherwise cause the container 100 to rock or wobble when resting on a flat horizontal surface.

The angling of the pivot axes may be achieved by angling the lower edge of a circular flange 612 that surrounds a pivot axis 611 on the container 100. The angle between the pivot axis and the vertical axis 970 of the container 100 can be called A1. The vertical axis of the container can be perpendicular to the plane defined by the bottom edge 179 of the container 100. As shown in FIG. 14, due to the angling of the axes the length L1 will be greater than the length L2. We have the formula:

$$L1-L2=L3*\mathrm{SINE}(2*A1)$$

which shows the convergence distance of two diagonally opposed axes 615, 635. The convergence of the axes causes a lowering of the leg ends 613 when extended. The lowering is shown by the arrows at 616 and 636 in FIG. 14.

Figure 18:
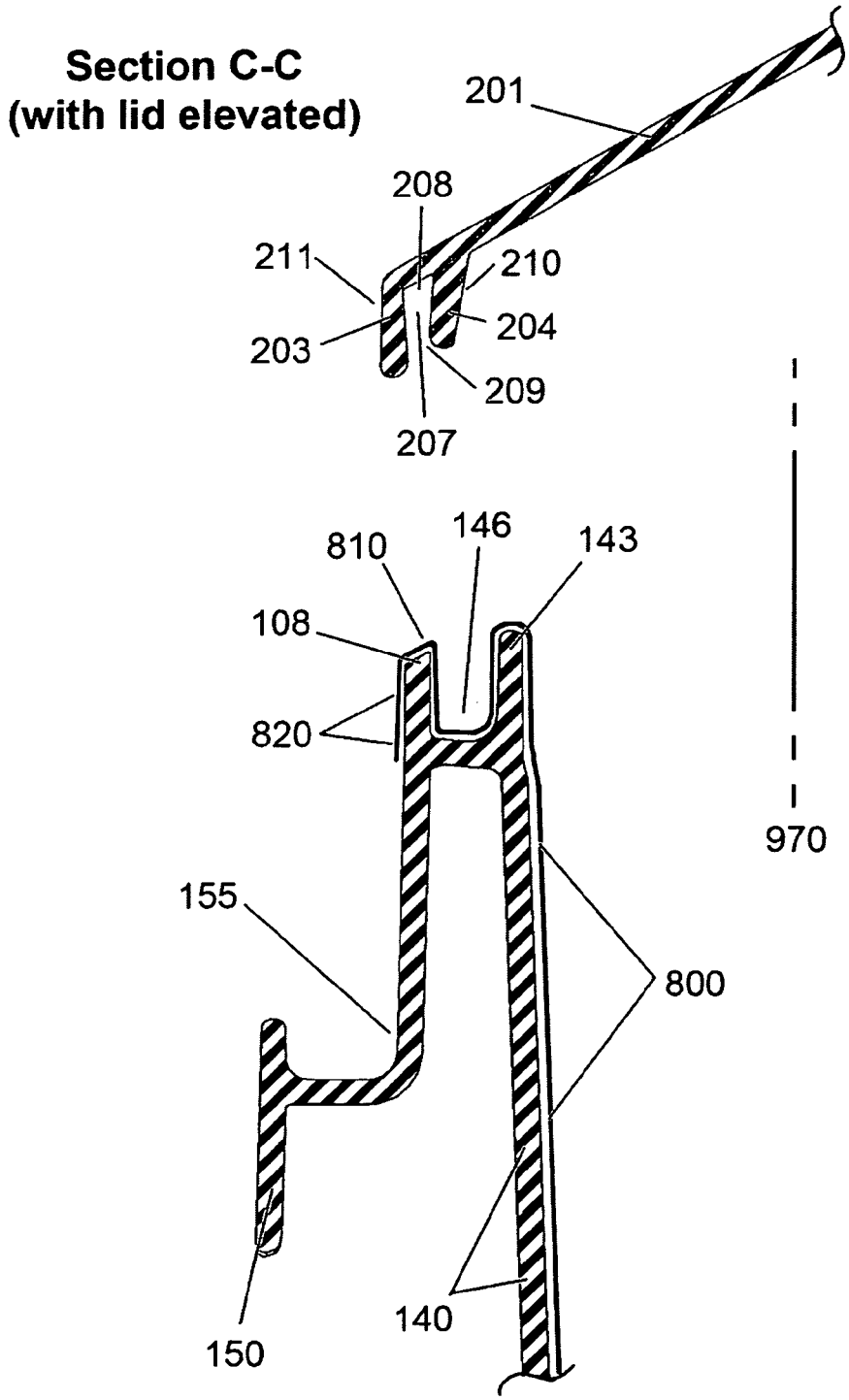
FIG. 18. A detail cross sectional view of the container, liner and lid, taken on a vertical plane C-C in FIG. 15, invention shown with the lid elevated, liner in place; the figure shows a cross section of the liner going over and around the brush grooming lip; this section is taken on the same plane as FIG. 16.
Figure 22A:
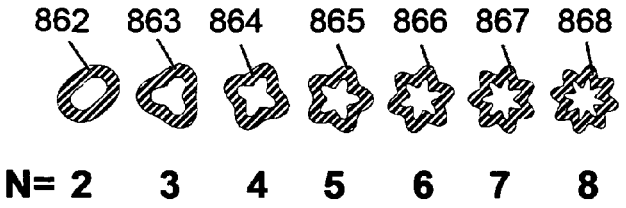
FIG. 22*a*. A series of cross sectional views of elastic collar stops with different numbers of periods of waviness 'N'.
Figure 22B:
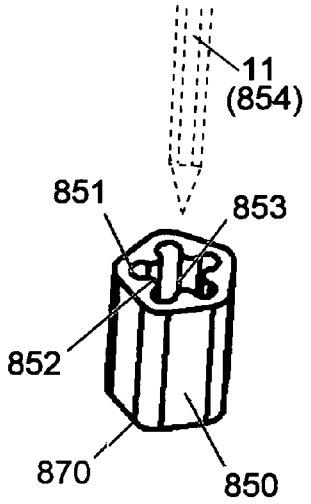
FIG. 22*b*. A perspective view of a pencil prior to insertion in an elastic tool stop collar (N=5).
Figure 23:
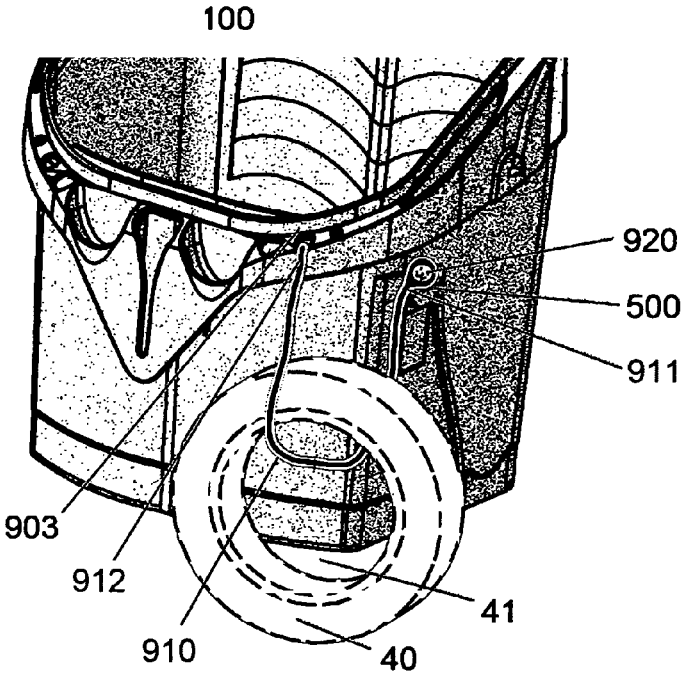
FIG. 23. A perspective view showing a preferred embodiment of a tape roll holder.

In a preferred embodiment, a removable liner 800 for the container 100 can be provided. The liner 800 can be formed to fit closely within the container 100, including fitting closely within any interior slots 176 designed to receive a paint spreading grid 70. This helps to assure that the grid 70 will still fit in place with a liner 800 installed. FIG. 18 shows the front upper portion of a liner 800 in cross section as the liner fits closely over the container 100 front lips 108 and 143. The liner 800 can comprise an upper portion that is configured to fit closely over a top lip of the container in such a manner that the liner extends over the top of the lip 810 and then downward by area 820 over the outside surface of the lip 108, thus allowing the downward extending lips of a sealing lid 203 and 204 to effectively engage the container top lip 108 with or without a liner 800 in place. A preferred embodiment of the present invention can provide a resilient stop unit 850 for a substantially cylindrical tool such as a pencil 11, pen or the like, as shown in FIGS. 22*a* and 22*b*. The stop unit 850 can be formed from a somewhat elastic material and can have a flexible hole 853 sized to fit snugly around the cylindrical portion of a tool 854 and an outer extent 870 somewhat larger than the size of the flexible tool hole 853.

The tool stop unit 850 can prevent a tool 854 from passing completely through a storage receptacle consisting of a through-hole, like 114, 116, or 144, in a substantially planar support element as may be found on the tool-holding flange 103 of the present container invention.

The stop collar can have a wavy form with the shape defined in polar coordinates, by the equation as a function of polar angle P1:

$$R1=B1+C1*\mathrm{SINE}(N*P1)=\text{interior edge shape}$$

$$R2=B2+C2*\mathrm{SINE}(N*P1)=\text{outline edge shape}$$

The integer N can be varied to provide a varying number of lobes as shown in FIG. 22*a*. When N=2, the resulting shape 862 can have an oval cross section. When N=3, the section 863 can be triangular. When N=8, the shape 868 is an eightpointed star, and so on. The waviness can provide for superior grip on a tool body as compared to a simple round hole.

A preferred embodiment of the present invention can provide a tape roll holder 900. The tape roll holder 900 can be configured to hold a roll of tape 40, such as masking tape, or a plurality of such tape rolls. The tape roll holder can comprise: a lineal flexible element 910 with a first and a second end (such as a length of nylon cord); a magnetically attractable element 920 (such as a ferrous fob) attached to the first end 911 of said flexible element; means of attaching the second end 912 of said flexible element to the container 100, such as a loop; and a magnet attached to the container 500.

The magnet can be capable of holding the fob 920, and the magnet can be located at a distance from the second end attachment point 903 that is less than the length of the flexible element 910.

To use the tape holder 900, the fob 912 end of the flexible element 910 can be passed though the central hole 41 of a tape roll 40, and then the fob 920 can be attached to the magnet 500. To remove the tape, the fob 920 can be manually detached from the magnet 500 and the tape roll 40 removed from the container 100 assembly.

In the foregoing discussion we make the preferred embodiments exemplary of all the possible features and elements of the present invention. It will be clear to one skilled in the art that embodiments which are limited to employing only some of the features disclosed herein will also fall within the scope of this invention.

APPENDIX A

Key Identifying Numbers Used in the Figures

11 PENCIL
20 PAINT BRUSH
21 STEEL BAND ON PAINT BRUSH
30 PUTTY KNIFE
31 STEEL BLADE OF PUTTY KNIFE
40 TAPE ROLL
41 CENTRAL HOLE OF TAPE ROLL
50 OPERATOR OF INVENTION
51 OPERATOR'S ARM
52 OPERATOR'S THUMB
53 OPERATOR'S HAND
60 PAINT ROLLING TOOL
61 ROLLER HANDLE GRIP
62 ROLLER HANDLE SHAFT
65 CYLINDRICAL ROLLER ELEMENT
66 LADDER
67 LADDER RUNG
68 CHAIR
69 CHAIR BACK
70 PAINT SPREADER SCREEN UNIT
71 TOP EDGE OF PAINT SPREADER SCREEN
72 SIDE BEAM OF PAINT SPREADER SCREEN
73 LOWER EXTENSION OF SIDE BEAM
74 CURVE OF SIDE BEAM EXTENSION
75 BOTTOM EDGE OF SPREADER SCREEN
76 CENTER OF SPREADER SCREEN
80 PAINT PAIL HOOK
81 FLEXIBLE ELEMENT ATTACHED TO PAIL HOOK
82 CLIP ELEMENT ATTACHED TO PAIL HOOK
90 WIPING CLOTH
100 CONTAINER ELEMENT
101 CONTAINER UNIT RESERVOIR
103 TOOL FLANGE
104 SIDE EDGE OF REAR FLANGE
106 NOTCH IN REAR WALL OF CONTAINER
108 VERTICAL TOP LIP OF CONTAINER
110 HORIZONTAL PORTION OF REAR FLANGE
111 VERTICAL PORTION OF REAR FLANGE
112 STRAP RETAINER CUTOUT ENCLOSED AREA
113 CARPENTER PENCIL HOLE
114 BIGGER TOOL RECEIVING CIRCULAR HOLE
115 LID HOLDING SLOT
116 TOOL RECEIVING HOLE
117 BAIL HANDLE STOP
118 STOP SUPPORT FLANGE
119 STRAP ATTACHING HOLE
120 PLASTIC MAGNET COVER EXTENSION
121 STRAP RETAINING CLIP
122 HANDLE PIVOT HOLE IN FLANGE
123 HOLE IN CLIP
124 GAP PRODUCESSED BY CLIP
125 MAGNET INSERTING TROUGH
128 REAR-SIDE CORNER OF CONTAINER
130 SIDE WALL OF CONTAINER
132 SIDE PORTION OF TOOL FLANGE
133 VERTICAL PORTION OF SIDE FLANGE
135 SIDE WALL OFFSET
136 HORIZONTAL PORTION OF FRONT FLANGE
137 PUTTY KNIFE RECEIVING SLOT
138 INNER EDGE OF PUTTY KNIFE SLOT
140 FRONT WALL OF CONTAINER
141 OUTWARDLY CONVEX PORTION OF FRONT WALL
142 FRONT OUTWARD FLANGE
143 VERTICAL BRUSH GROOMING LIP
144 FRONT TOOL RECEIVING HOLES
145 CENTRAL INDENTATION IN FRONT WALL
146 BRUSH GROOMING LIP TROUGH
148 FRONT-SIDE CORNER
150 FRONT FLANGE VERTICAL PORTION
151 CLOTH HOLDING GROOVE
152 LOWEST POINT OF FRONT FLANGE
153 LOWER PORTION OF CLOTH HOLDER
154 CLOTH HOLDER SUPPORTING WEB
155 PUTTY POCKET
160 REAR WALL OF CONTAINER
161 TEXTURED INNER FACE OF REAR WALL
162 TEXTURED PATTERN OF REAR WALL
165 VERTEX OF PATTERN
167 RADIUSED INNER CORNER OF PATTERN
168 HORIZONTAL LEDGE OF TEXTURED PATTERN
169 VERTICAL FACE OF TEXTURED PATTERN
170 BOTTOM ELEMENT OF CONTAINER
171 FRONT PLANAR SECTION OF BOTTOM
172 RECESSED PAINT WELL FOR ROLLER
173 BOTTOM STIFFENING RIB
174 FLAT SLOPING AREA OF BOTTOM
175 SPREADER SCREEN SUPPORT WEB
176 SPREADER SCREEN RECEIVING SLOT
177 BOTTOM PERIMETER FLANGE
178 CUT OUTS IN BOTTOM FLANGE
179 LOWEST EDGE OF BOTTOM FLANGE
180 OPEN TOP OF CONTAINER
185 TOP EDGE OF SCREEN SUPPORTING WEB
190 BOTTOM BOSS ON CONTAINER
200 LID ASSEMBLY
201 LID ELEMENT
202 LID IN REAR STOWAGE POSITION
203 LID OUTER SEALING LIP
204 LID INNER SEALING LIP
205 LID FRONT LIFT TAB

Figure 15:
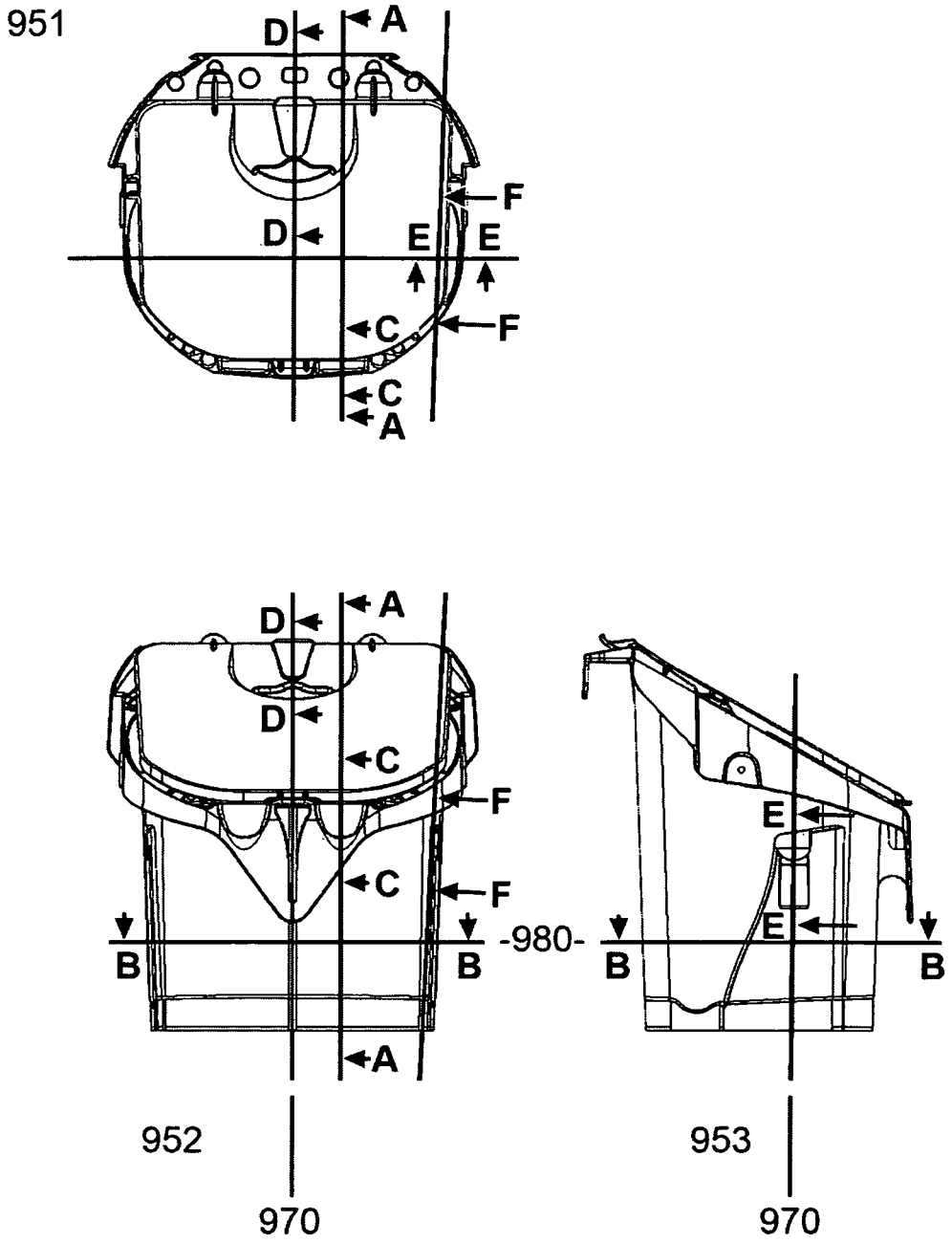
FIG. 15. A three-view drawing showing the locations of the various sectional views used in the figures, the invention is shown with the lid closed.

206 NOTCH IN LID
207 SEALING SLOT IN LID
208 LID SLOT BASE
209 LID SEALING SLOT ENTRANCE
210 INNER FACE OF INNER LIP
211 OUTER FACE OF OUTER LIP
220 LID SIDE LIFT TAB
225 SIDE CLIP-ON TAB
230 REAR LIFT AND STOWAGE TAB ON LID
231 INDENTATION AT BASE OF TAB
233 LID REAR EDGE
250 FLAP CLEARANCE RECESS ON LID
251 OUTER FLAP RECESS IN LID
252 INNER DEEPER FLAP PROTUBERANCE RECESS
260 PIVOT POINT FOR NOTCH SEALING FLAP
300 LID NOTCH COVERING FLAP
301 FLAP IN CLOSED POSITION
302 FLAP IN OPEN POSITION
310 NOTCH COVERING PROTUBERANCE ON FLAP
320 AXIS OF PIVOTING FLAP
321 FLAP PIVOT ELEMENT
400 HANDLE ASSEMBLY
405 BAIL HANDLE ELEMENT
406 BAIL HANDLE SUSPENSION HOOK ATTACHMENT POINT
407 HANDLE PIVOT PRONGS
410 HANDLE GRIP
411 HANDLE GRIP CUT OUT
415 HANDLE PIVOT AXIS
500 MAGNET
505 MAGNET RECEIVER POCKET
510 INNER FACE OF MAGNET AREA
520 OUTER FACE OF MAGNET AREA
530 MAGNET HOLDING EAR
550 MAGNET POCKET
610 LEFT FRONT LEG
611 PIVOT POINT OF FRONT LEFT LEG
612 CIRCULAR LEG SUPPORT FLANGE
613 OUTER DISTAL PORTION OF LEG
615 PIVOT AXIS OF FRONT LEFT LEG
616 LOWERING OF LEFT FRONT LEG
620 LEFT REAR LEG
621 PIVOT POINT OF LEFT REAR LEG
630 RIGHT REAR LEG
631 PIVOT POINT OF RIGHT REAR LEG
635 PIVOT AXIS OF RIGHT REAR LEG
636 LOWERING OF RIGHT REAR LEG
640 RIGHT FRONT LEG
641 PIVOT POINT OF RIGHT FRONT LEG
700 STRAP ASSEMBLY
710 STRAP LOOP ADJUSTER SLIDER
720 STRAP LOOP ADJUSTING RING
730 STRAP ATTACHING CLIP
750 LOWER PORTION OF STRAP LOOP
760 UPPER ADJUSTABLE PORTION OF STRAP LOOP
800 REMOVABLE LINER
810 TOP EDGE OF LINER
820 VERTICAL PORTION AT OUTERMOST EDGE OF LINER
850 COLLAR STOP FOR TOOL
851 TROUGH INSIDE HOLE
852 RIDGE INSIDE HOLE
853 CENTRAL HOLE IN COLLAR STOP
854 CYLINDRICAL TOOL
870 OUTER EDGE OF COLLAR STOP
900 TAPE ROLL HOLDER ASSEMBLY
903 ATTACHMENT POINT FOR FLEXIBLE ELEMENT
910 FLEXIBLE ELEMENT OF TAPE ROLL HOLDER
911 FIRST END O FLEXIBLE ELEMENT
912 SECOND END O FLEXIBLE ELEMENT
920 FERRIS FOB ELEMENT OF TAPE ROLL HOLDER
951 TOP VIEW OF INVENTION, FIG. 15
952 FRONT VIEW OF INVENTION, FIG. 15
953 SIDE VIEW OF INVENTION, FIG. 15
970 VERTICAL REFERENCE LINES
980 HORIZONTAL PLANE 'B'

What is claimed is:

1. A hand-transportable container capable of holding a quantity of liquid and a plurality of tools, said container comprising:

(a) a bottom, said bottom being contoured to provide stable support for said container when said container is resting upon a flat and substantially horizontal surface (b) a front wall, an upper edge of said front wall, a lower portion of said front wall and an outer face of said front wall (c) at least one side wall, each side wall having an upper edge, a lower portion and an outer face (d) a rear wall, an upper edge of said rear wall, a lower portion of said rear wall and an outer face of said rear wall (e) a first lip formed by the combined upper edges of the walls (f) a reservoir located above said bottom and between the lower portions of the walls (g) a first opening which is defined by the first lip and combined upper edges of the walls, said opening providing access to said reservoir (h) a flange which projects outwardly from the outer face of at least one of the walls from a location within approximately two inches of said first lip (i) a pivoting handle assembly, including a bail formed of a substantially rigid material, and an enlarged diameter handle grip in the central section of the handle assembly (j) a first means of limiting the pivoting travel of said handle assembly such that said handle grip is securely positioned in a location approximately 1 to 4 inches above said flange by a downward force when said handle assembly is at the end of its pivoting travel as provided by said first means, whereby the combination of the grip and the flange produce a secure handhold of substantial vertical extent when the handle is positioned by the stop action of said first means, such that a person can hold the container securely with one hand and have the other hand free to do other work.

2. The container of claim 1 wherein said first means of limiting the pivoting travel of said handle assembly comprises at least one stop located on said flange, said stop limiting the pivoting motion of said handle assembly by contacting said handle assembly when said handle grip reaches a predetermined location above said flange.

3. The container of claim 1 wherein said first means of limiting the pivoting travel of said handle assembly comprises a plurality of stops, at least one stop being located on either side of said container on said flange, said stops limiting the pivoting motion of said handle assembly by contacting said handle assembly when said handle grip reaches a predetermined location above said flange.

4. The container of claim 1 wherein said handle assembly additionally comprises a second means of providing a secure and strong attachment point in the central section of said handle assembly, said second means comprising an indentation in the central section of said bail in combination with a cutout in said handle grip, a second opening is provided by said second means, whereby said container can be securely suspended by a supporting element that passes through said second opening and engages said indentation in said bail, this prevents the support element from moving along said bail, thus reducing danger of upset of spillage.

5. A hand-transportable container capable of holding a quantity of liquid and a plurality of tools, said container comprising:

(a) a bottom, said bottom being contoured to provide stable support for said container when said container is resting upon a flat and substantially horizontal surface (b) a front wall, an upper edge of said front wall, a lower portion of said front wall and an outer face of said front wall (c) at least one side wall, each side wall having an upper edge, a lower portion and an outer face (d) a rear wall, an upper edge of said rear wall, a lower portion of said rear wall and an outer face of said rear wall (e) a first lip formed by the combined upper edges of the walls (f) a reservoir located above said bottom and between the lower portions of the walls (g) a first opening which is defined by the first lip and combined upper edges of the walls, said opening providing access to said reservoir (h) a flange projecting outwardly from the outer face of at least one of the walls from a location within approximately two inches of said first lip (i) a first portion of said flange projecting out approximately horizontally from the outer face of the wall, an outer edge of said first portion being approximately straight (j) a second portion of said flange projecting approximately vertically downward from said outer edge of said first portion whereby the container can be securely supported by hooking the flange second portion over a horizontal edge as is found on the top edge of a door, the flange first part resting on the door edge supports the container weight, the flange second part holds the container in proximity to the door edge.

6. The container of claim 5 additionally comprising a lower edge of said second portion of said flange, and a notch in said lower edge, whereby the container can be hung on a knob by hooking the flange over the knob such that the notch engages the knob, this engagement prevents slipping.

7. The container of claim 6 wherein said notch is approximately ½ inch in vertical extent and approximately 1-2 inches in horizontal extent.

8. The container of claim 5 wherein said first portion is approximately 1-2 inches in outward horizontal extent and said second portion is approximately 1-2 inch in vertical extent.

9. The container of claim 5 wherein said rear wall is substantially planar and said rear wall is positioned on said container so that said rear wall is oriented in an approximately vertical position when said container is sitting on said bottom and resting normally on a horizontal surface, and wherein said first portion of said flange projects outward from said outer face of said rear wall, whereby the upper edge of the rear wall is approximately straight and the flange can provide additional stability by being wide in a side to side direction.

10. The container of claim 5 wherein a plurality of holes are provided in said flange, whereby tools and supplies can be stored and carried in the holes.

11. The container of claim 5 additionally comprising at least one receiving slot in said flange, a first means of retaining strap material being provided by said slot, whereby a person can detachably attach carrying strap material to the container.

12. The container of claim 11 wherein a pair of receiving slots is provided in said flange, said slots being located near the ends of said outer edge of said first portion of said flange, said slots providing a pinching means of retaining strap material, whereby carrying strap material can be detachably attached to the container.

13. The container of claim 12 wherein a plurality of holes are provided in said flange proximal to the retaining slots, a locking means is provided by the holes, said locking means prevents the strap material from being removed from the slot whereby a person can prevent the strap material from slipping out of the slots by connecting two holes that are located on either side of the receiving end of the slot.

14. A hand-transportable container capable of holding a quantity of liquid and a plurality of tools, said container comprising:

(a) a bottom, with an inner surface and an outer surface, said outer surface being contoured to provide stable support for said container when said container is resting upon a flat and substantially horizontal surface (b) a front wall, an upper edge of said front wall, a lower portion of said front wall, an inner face of said front wall and an outer face of said front wall (c) at least one side wall, each side wall having an upper edge, a lower portion, an inner face and an outer face (d) a rear wall, an upper edge of said rear wall, a lower portion of said rear wall, an inner face of said rear wall and an outer face of said rear wall, said rear wall being substantially planar and said rear wall being positioned on said container so that said rear wall is oriented in an approximately vertical position when said container is sitting on said bottom and resting normally on a horizontal surface (e) a first lip formed by the combined upper edges of the walls, (f) a reservoir located above said bottom and between the lower portions of the walls (g) a first opening whose perimeter is defined by the first lip and combined upper edges of the walls, said first opening providing access to said reservoir, a first plane is approximately defined by said first opening such that in a normally resting container with all walls of equal height said first plane will be horizontal (h) said first opening being inclined towards the front such that the first plane is approximately 15 to 45 degrees from horizontal, and such that the upper edge of the front wall is lower than the upper edge of the rear wall (i) a flange which projects outwardly from the outer face of at least one of the walls from a location within approximately two inches of said first lip, a plurality of holes are provided in said flange whereby a worker has ready access through the inclined opening to liquid material within the reservoir area and to tools stored in the flange holes.

15. The container of claim 14 wherein said inner face of said rear wall is provided with a textured pattern, whereby paint may be redistributed on paint tools by rubbing the tool on the textured inner face.

16. The container of claim 14 wherein said flange comprises at least one indentation that forms a recessed means of holding pliable material, whereby the pliable material may be stored and carried.

17. The container of claim 16 wherein said recessed means comprises a pair of separated indentations located on said flange proximal to said upper edge of said front wall, whereby two types of pliable material can be carried separately.

18. The container of claim 14 wherein at least one of the holes in said flange is of approximately ⅜ inch in diameter, thereby the hole can receive a standard pencil.

19. The container of claim 14 wherein said front wall comprises two outwardly convex approximately cylindrical shapes that meet in the middle of said front wall in a shallow trough as viewed from the front of the container, whereby the wall is strengthened.

20. The container of claim 14 additionally comprising a second lip attached to the inner face of at least one wall, said second lip being located within the perimeter of said first opening separated from said first lip by a gap of predetermined width, a drainage means is provided for liquid matter that goes into said gap, whereby a person can remove excess paint from a brush by scraping the bristles over said second lip, paint that enters said gap will drain back into said reservoir.

21. The container of claim 14 additionally comprising a first section of said flange with an outer edge, and an elongated hole proximal to the first section outer edge, a band portion of said flange being provided by the part of the first section of flange located between said elongated hole and the first section outer edge, whereby a putty knife or other tool can be stored in the elongated hole, alternately a clip-on tape measure may be clipped to the band portion of the flange section.

22. The container of claim 21 wherein said elongated hole is approximately 2-4 inches in long dimension and approximately ¼-½ inches in short dimension.

23. The container of claim 21 wherein said first section is located proximal to the forward portion of at least one said side wall.

24. The container of claim 14 additionally comprising a second section of said flange, a jamming means being provided in said second section, said jamming means including a tapering hole in said second section, said tapering hole having elongate outline that narrows at one end in a curving V shaped fashion, said elongate hole having nearly parallel sides that are close together near its narrow end, whereby a cleaning cloth may be jammed into the tapering portion of the hole and retained by friction between the cloth and the nearly parallel sides.

25. The container of claim 14 further comprising a plurality of structural ribs on said outer surface of said bottom, whereby said bottom gains structural integrity.

26. The container of claim 25 additionally comprising a hub on said outer surface of said bottom, and at least three structural ribs radiating from said hub, whereby plastic may be more easily injected into a mold at said hub.

27. The container of claim 14 additionally comprising: a well region of said inner surface of said bottom, a front planar region of said inner surface of said bottom and a rear flat sloping region of said inner surface of said bottom, wherein said well has an approximately cylindrical form, the axis of the cylinder being oriented side to side.

28. The container of claim 14 additionally comprising at least one web extending upwards for a predetermined distance from said inner surface of said bottom, whereby multiple containers can be nested and stacked without getting stuck together.

29. The container of claim 28 wherein at least one web is proximal to said rear wall and is approximately parallel to said rear wall, the distance between said web and said wall being predetermined, whereby a painter's grid can be held in place proximal to the rear wall.

30. The container of claim 14 additionally comprising an upwards extension of said lip of said container, said extension being in the form of a cylinder, the axis of said cylinder being vertical, and the sweeping profile of said cylinder matching in shape the upper edges of the walls, whereby a sealing lid may placed on the container with a sliding motion along the axis of said cylinder.

31. The container of claim 14 additionally comprising at least one pocket located within one of the walls, whereby said pocket can contain some material within the container wall.

32. The container of claim 31 additionally comprising a pair of flexible ears located within said pocket, whereby suitably shaped material may be pushed into the pocket and snap into place.

33. The container of claim 32 wherein said pocket opens downward and to the outside of said container, whereby contents of the Pocket are isolated from the contents of the reservoir area.

34. The container of claim 14 additionally comprising at least one indentation in said first lip, said indentation being substantially in the form of a portion of a circular cylinder, the axis of said circular cylinder protruding from said reservoir, whereby paint tool handles may rest in the indentation.

35. The container of claim 34 wherein the diameter of said circular cylinder is approximately 0.23 inches, whereby said indentation fits handle shafts of standard mini-rollers.

* * * * *